US007181149B2

(12) United States Patent
Joichi et al.

(10) Patent No.: US 7,181,149 B2
(45) Date of Patent: Feb. 20, 2007

(54) IMAGE FORMING APPARATUS

(75) Inventors: Norio Joichi, Kokubunji (JP); Tadashi Matsudaira, Hachioji (JP); Youbao Peng, Hino (JP); Hiroshi Oyama, Hino (JP); Katsunori Takahashi, Hachioji (JP); Masayuki Watanabe, Fuchu (JP); Yoshiki Katayama, Hachioji (JP); Shinpei Kawasaki, Hachioji (JP); Takashi Nara, Niiza (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 150 days.

(21) Appl. No.: 10/949,455

(22) Filed: Sep. 27, 2004

(65) Prior Publication Data

US 2005/0135828 A1 Jun. 23, 2005

(30) Foreign Application Priority Data

Dec. 17, 2003 (JP) ..... 2003-419430
Dec. 25, 2003 (JP) ..... 2003-430694

(51) Int. Cl.
*G03G 21/00* (2006.01)

(52) U.S. Cl. ..... 399/75; 399/37; 399/70; 399/88

(58) Field of Classification Search ..... 399/75, 399/70, 76, 88, 37
See application file for complete search history.

(56) References Cited

U.S. PATENT DOCUMENTS 6,427,056 B1 * 7/2002 Kawano et al. ..... 399/67
6,567,626 B2 * 5/2003 Akaike et al. ..... 399/75

* cited by examiner

*Primary Examiner*—David M. Gray
*Assistant Examiner*—Erika J. Villaluna
(74) *Attorney, Agent, or Firm*—Finnegan, Henderson, Farabow, Garrett & Dunner, L.L.P.

(57) ABSTRACT

There is described an image forming apparatus, in which the influence of the overall controlling section startup time is reduced, thereby cutting down the time from turning on of power to enabling of image formation. The image forming apparatus includes: a main power switch to turn ON/OFF an AC power source to be supplied into the image forming apparatus; a DC power current generating section to convert AC power current, fed from the AC power source, to DC power current; an overall-controlling section to control overall operations of the image forming apparatus; an engine-controlling section to conduct a predetermined controlling operation among from controlling operations to be conducted in the image forming apparatus; a first power-controlling section, included in the overall-controlling section and/or controlled by the overall-controlling section; and a second power-controlling section, having a starting time shorter than that of the first power-controlling section.

22 Claims, 13 Drawing Sheets

IMAGE FORMING APPARATUS

BACKGROUND OF THE INVENTION

The present invention relates to an image forming apparatus for forming an image on a recording medium.

When image data is to be outputted in an image forming apparatus such as a laser printer and copying machine, a toner image is developed on a photoconductor drum based on the image data, and is transferred on a recording medium such as paper. Then heat and pressure are applied by a fixing device, and an image is formed on the recording medium. Since heating by the fixing device requires a predetermined time, several means have been devised in the conventional apparatus to reduce time from turning on of power to enabling of image formation. Referring to FIGS. 12 and 13, the configuration of reducing the time from turning on of power to enabling of image formation in a copying machine 200 will be described, using an example of the configuration for reducing the time from turning on of power to enabling of image formation. FIG. 12 shows the control configuration in a copying machine 300. FIG. 13 shows the conventional processing of starting image formation applied in the copying machine 300.

As shown in FIG. 12, the copying machine 300 includes: an AC (alternating current) power supply 11; a main power supply switch 12 for turning on and off the AC power supply 11; a DC power supply 13 for converting the AC power supply power inputted from the AC power supply 11 and producing the DC (direct current) power supply output as the first and second DC power supply output; an AC drive section 14 for driving the fix-heating section 21 by heating power; a sub-power supply switch 15 as a power supply switch on the operation panel or the like; a power supply control section 16B for controlling the second DC power supply output from the DC power supply 13; an overall controlling section 17C for controlling creation of an image page; an engine controlling section 18 for controlling the fixing system and sheet feed system (not illustrated); a main relay 19 for switching the supply of power to the AC drive section 14; a fixing roller 20 for applying heat and pressure to the recording medium with a toner image transferred thereto by a photoconductor drum (not illustrated); a fix-heating section 21 consisting of an induction heating coil for heating the fixing roller 20; a motor 22, for rotating the fixing roller 20, consisting of a motor for rotating the fixing roller 20; and a temperature sensor 23 for detecting the temperature of the fixing roller 20.

FIG. 12 does not include the illustration of a sheet feeding means of the copying machine 300, image forming means including a photoconductor drum, means for communication with an external device such as a PC, or image reading means for reading a document. The fixing device contains a fixing roller 20, fix-heating section 21, temperature sensor 23 and motor 22.

Then the operation of the copying machine 300 will be described with reference to FIG. 13. As shown in FIG. 13, when the main power supply switch 12 is turned on, the AC supply power is converted by the power supply 13 and is outputted to the power supply control section 16B as the first DC power supply output (Step S71). Then the power supply control section 16B is activated by the first DC power supply output (Step S72). Then evaluation is made to see whether or not the sub-power supply switch 15 is turned on by the operator (Step S73).

If the sub-power supply switch 15 is not turned on (NO in Step S73), the system goes to Step S73. If the sub-power supply switch 15 is turned on (YES in Step S73), the start signal is outputted from the sub-power supply switch 15 and is inputted into the power supply control section 16B. When the start signal has been inputted, a power supply control signal is generated and outputted by the power supply control section 16B, and is inputted into the DC power supply 13. When the power supply control signal has been inputted, the second DC power supply output is generated and outputted by the second DC power supply 13 and is inputted into the overall controlling section 17 and engine controlling section 18 (Step S74).

When the second DC power supply has been inputted, the overall controlling section 17C starts to operate (Step S75A). In parallel with the Steps S75A, the engine controlling section 18 also starts operation when the second DC power supply has been inputted (Step S75B). When at least one of the Steps S75A and S75B has started, initial communication is tried between the overall controlling section 17C and engine controlling section 18 (Step S76). Evaluation is made to see whether or not communication has been established between the overall controlling section 17C and engine controlling section 18 (Step S77). In order for communication to be established between the overall controlling section 17C and engine controlling section 18, both the overall controlling section 17C and engine controlling section 18 must have been started.

If initial communication is not established (NO in Step S77), the system proceeds to Step S76. If initial communication has been established (YES in Step S77), the main relay 19 is turned on and the AC supply power outputted from the AC power supply 11 is inputted into the AC drive section 14, and the control signal is generated and outputted from the engine controlling section 18 to be inputted into the AC drive section 14 and motor 22. When the AC supply power and control signal have been inputted, the AC heating power is outputted from the AC drive section 14 and is inputted into the fix-heating section 21. Then the fixing roller 20 is heated and warm-up operation is performed (Step S78).

After initial communication has been established, the overall controlling section 17C generates the power control command, which is inputted into the power supply control section 16B. Based on the power supply control command, power supply control signal is generated and outputted by the power supply control section 16B, and is inputted into the DC power supply 13. This is followed by correction of the preliminary rotation of the fixing roller 20 by the motor 22 with control signal inputted therein, and preliminary operations such as preliminary control of each section by the overall controlling section 17C and engine controlling section 18 (Step S79). Then this will terminate processing of image formation according to the conventional image-forming startup procedure.

The time from turning on of power to enabling of image formation can be reduced more by simultaneous activations of both the overall controlling section 17C in the Step S75A and the engine controlling section 18 in the Step S75B, than by the sequential activation of them.

It is also possible to arrange such a configuration that the power save mode is activated before the overall controlling section and engine controlling section are started. To put it more specifically, a power save mode operates as follows: After the main power supply switch is turned on, the power supply control means of the main relay for applying power to the fixing device is started first. The main relay is turned on by the started power supply control means, and the fixing device is heated to a predetermined temperature, whereby low power is supplied to the fixing device. Then the overall controlling section and engine controlling section are automatically started to perform initial communication. The engine controlling section having been started causes various forms of processing, such as heating of the fixing device and correction of preliminary rotation. Since the fixing device is heated before the overall controlling section and engine controlling section are started, the time from turning on of power to enabling of image formation can be reduced.

Similarly to the configuration of the aforementioned power save mode, after power has been turned on, the power save mode is activated. When the power save mode release command has been inputted, the overall controlling section and the engine controlling section are started. Such a configuration can also be considered (e.g. Patent Document 2).

[Patent Document 1] Official Gazette of Japanese Patent Tokkai-2000-214734

[Patent Document 2] Official Gazette of Japanese Patent Tokkai-2001-22234

An image forming apparatus incorporates a system CPU for managing the overall status of the image forming apparatus, and an engine CPU for controlling the sheet feed system and fixing device. After power has been turned on, the system CPU and engine CPU are started. Then the fixing control of the fixing device is provided by the engine CPU, according to the conventional method. Since a predetermined time is required to heat the fixing device, means have been devised in the conventional apparatus to reduce time from turning on of power to enabling of image formation.

The fixing heater of the fixing device is provided with a first fixing heater having a capacity for normal image formation, and a second fixing heater having a capacity greater than that of the first fixing heater. Before the image forming apparatus has been started, power is supplied to the second fixing heater to cause a sudden temperature rise. Then power is supplied to the second fix-heater after the image forming apparatus has been started, so that an image can be formed. In this manner, the time for enabling mage formation is reduced, according to the conventional method (e.g. Patent Document 3).

[Patent Document 3] Official Gazette of Japanese Patent Tokkai 2000-330430

In recent years, however, there has been a trend toward increasing size and multifunctionality of the image forming apparatus. The program read out by the overall controlling section is getting more and more complicated, and hence a long time is required to load such a program. More time must be spent to start the overall controlling section. In the configuration of the copying machine 300 shown in FIGS. 10 and 11, there is apprehension that the time required to start up the overall controlling section 17C in Step S75A of processing the image formation in the conventional image-forming apparatus may be longer than the time for starting up the engine controlling section 18 in Step S75B. To put it another way, even when the engine controlling section 18 has been started and the system is ready to heat the fixing device, it is necessary to wait for the overall controlling section 17C to be started up, according to the conventional apparatus.

In the configuration described in Patent Documents 1 and 2, the fixing device is heated at a low power in advance. This arrangement reduces the time for the fixing device to be heated to the temperature required for image formation. However, the starting of the overall controlling section and heating and preliminary heating of the fixing device are sequential, and this may cause a delay in starting the preliminary operation such as heating of the fixing device by the engine controlling section and correction of the preliminary rotation, subsequent to the completion of starting of the overall controlling section and the engine controlling section and completion of initial communication, similarly to the case of the configuration of the copying machine 300.

In recent years, an electromagnetic induction heater (IH) that does not take much heating time has come to be employed as a fix-heating section of the fixing device, in place of a halogen heater requiring a longer heating time to reach a predetermined temperature. As a result, the required time from turning on of power to enabling of image formation is affected more by the percentage of the increase in the startup time of the overall controlling section, than by the time of heating the fixing device.

Further, in recent years, there has been a trend toward increasing size and multifunctionality of the image forming apparatus. The program read out by the overall controlling section is getting more and more complicated, and hence a long time is required to load such a program. More time must be spent to start the overall controlling section. Thus, when the fixing control of the fixing device is provided by the engine controlling section after starting up of the system control section, the startup time of the system control section is very long. There is apprehension that this will increase the time from turning on of power to enabling of image formation, according to the conventional image-forming method.

According to the conventional arrangement of heating a second fixing heater having a greater capacity to reach the temperature that permits image formation, it is possible to reduce the time for reaching the temperature that permits image formation. However, this method fails to reduce the influence of the system control section startup time, upon the time from turning on of power to enabling of image formation.

SUMMARY OF THE INVENTION

To overcome the abovementioned drawbacks in conventional image-forming apparatus, it is an object of the present invention to provide an image forming apparatus, in which the influence of the overall controlling section startup time is reduced, thereby cutting down the time from turning on of power to enabling of image formation.

Accordingly, to overcome the cited shortcomings, the abovementioned object of the present invention can be attained by image-forming apparatus described as follow.

(1) An apparatus for forming an image on a recording medium, comprising: a main power switch to turn ON/OFF an AC power source to be supplied into the apparatus; a DC power current generating section to convert AC power current, fed from the AC power source, to DC power current; an overall-controlling section to control overall operations of the apparatus; an engine-controlling section to conduct a predetermined controlling operation among from controlling operations to be conducted in the apparatus; a first power-controlling section, included in the overall-controlling section and/or controlled by the overall-controlling section; and a second power-controlling section, having a starting time shorter than that of the first power-controlling section; wherein, when the main power switch is turned ON, the DC power current generating section supplies a first DC power current to both the first power-controlling section and the second power-controlling section, so as to commence to activate them, and then, the second power-controlling section generates a power controlling signal before initial settings of the first power-controlling section are completed, so as to input the power controlling signal into the DC power current generating section; and wherein, based on the power controlling signal inputted from the second power-controlling section, the DC power current generating section generates a second DC power current, and then, supplies the second DC power current into both the overall-controlling section and the engine-controlling section so as to activate them; and wherein the overall-controlling section is activated by the second DC power current, fed from the DC power current generating section, after the initial settings of the first power-controlling section are completed, and then, the first power-controlling section controls the DC power current, outputted from the DC power current generating section, after initial settings of the overall-controlling section are completed.

(2) The apparatus of item 1, wherein, when the main power switch is turned ON, the DC power current generating section commences to activate both the first power-controlling section and the second power-controlling section in parallel.

(3) The apparatus of item 1, further comprising: a fixing section to fix a developed image on a recording medium; and a sub-controlling section, having a starting time shorter than that of the engine-controlling section, to control a heating operation conducted by the fixing section; wherein, based on the power controlling signal inputted from the second power-controlling section, the DC power current generating section also supplies the second DC power current into the sub-controlling section so as to activate the sub-controlling section; and wherein the sub-controlling section controls the fixing section, so that a pre-heating operation of the fixing section is conducted by employing the AC power current supplied from the AC power source, before initial settings of the engine-controlling section are completed.

(4) The apparatus of item 3, wherein, when a temperature of the fixing section reaches to a predetermined temperature before the initial settings of the engine-controlling section are completed, the sub-controlling section keeps to a temperature controlling operation so as to maintain the predetermined temperature until the initial settings of the engine-controlling section are completed; and wherein, in case that a temperature of the fixing section does not reach to the predetermined temperature when the initial settings of the engine-controlling section are completed, the engine-controlling section conducts an operation for heating the fixing section.

(5) The apparatus of item 3, further comprising: a fixing-allowance signal generating section to generate a fixing-allowance signal for enabling the-pre-heating operation of the fixing section; wherein, when the main power switch is turned ON, the DC power current generating section also supplies the first DC power current to the fixing-allowance signal generating section, so as to commence to activate it, and then, the fixing-allowance signal generating section generates the fixing-allowance signal when the pre-heating operation of the fixing section is possible after the initial settings of the engine-controlling section are completed; and wherein, based on the fixing-allowance signal, the sub-controlling section controls the fixing section, so as to conduct the pre-heating operation of the fixing section.

(6) The apparatus of item 1, further comprising: an activating section to turn ON/OFF the DC power current; wherein, when the activating section turns ON the DC power current, the second power-controlling section controls a second DC power current outputted from the DC power current generating section.

(7) The apparatus of item 1, wherein the second power-controlling section is integrally included in the engine-controlling section.

(8) The apparatus of item 1, wherein the starting time of the second power-controlling section is shorter than 1 second.

(9) An apparatus for forming an image on a recording medium, comprising: a main power switch to turn ON/OFF an AC power source to be supplied into the apparatus; a DC power current generating section to convert AC power current, fed from the AC power source, to DC power current; a power-source controlling section to control the DC power current outputted from the DC power current generating section; an overall-controlling section to control overall operations of the apparatus; an engine-controlling section to conduct a predetermined controlling operation among from controlling operations to be conducted in the apparatus; and a fixing section to fix a toner image on a recording medium; wherein, when the main power switch is turned ON, the DC power current generating section supplies a first DC power current to the power-source controlling section so as to commence to activate it, and then, the power-source controlling section generates a first power controlling signal so as to input the first power controlling signal into the DC power current generating section; and wherein, based on the first power controlling signal inputted from the power-source controlling section, the DC power current generating section generates a second DC power current, and then, supplies the second DC power current into both the overall-controlling section and the engine-controlling section so as to commence to activate them; and wherein the power-source controlling section generates a second power controlling signal after initial settings of the engine-controlling section are completed, so as to input the second power controlling signal into the DC power current generating section; and wherein, based on the second power controlling signal inputted from the power-source controlling section, the DC power current generating section generates a third DC power current; and wherein the engine-controlling section, whose initial settings are already completed, conducts a heating operation of the fixing section by employing AC power current, fed from the AC power source, and controls a preliminary operation, which does not require a completion of initial settings of the overall-controlling section, by employing the third DC power current generated by the DC power current generating section.

(10) The apparatus of item 9, wherein the DC power current generating section commences to activate both the overall-controlling section and the engine-controlling section in parallel.

(11) The apparatus of item 9, further comprising: a sub-controlling section, having a starting time shorter than that of the engine-controlling section, to control a heating operation conducted by the fixing section; wherein, based on the first power controlling signal inputted from the power-source controlling section, the DC power current generating section also supplies the second DC power current into the sub-controlling section so as to activate the sub-controlling section; and wherein the sub-controlling section controls the fixing section, so that a pre-heating operation of the-fixing section is conducted by employing the AC power current supplied from the AC power source, before initial settings of the engine-controlling section are completed.

(12) The apparatus of item 11, wherein, when a temperature of the fixing section reaches to a predetermined temperature before the initial settings of the engine-controlling section are completed, the sub-controlling section keeps to a temperature controlling operation so as to maintain the predetermined temperature until the initial settings of the engine-controlling section are completed; and wherein, in case that a temperature of the fixing section does not reach to the predetermined temperature when the initial settings of the engine-controlling section are completed, the engine-controlling section conducts an operation for heating the fixing section.

(13) The apparatus of item 11, further comprising: a fixing-allowance signal generating section to generate a fixing-allowance signal for enabling the pre-heating operation of the fixing section; wherein, when the main power switch is turned ON, the DC power current generating section also supplies the first DC power current to the fixing-allowance signal generating section, so as to commence to activate it, and then, the fixing-allowance signal generating section generates the fixing-allowance signal when the pre-heating operation of the fixing section is possible after the initial settings of the engine-controlling section are completed; and wherein, based on the fixing-allowance signal, the sub-controlling section controls the fixing section, so as to conduct the pre-heating operation of the fixing section.

(14) An apparatus for forming an image on a recording medium, comprising: a main power switch to turn ON/OFF an AC power source to be supplied into the apparatus; a DC power current generating section to convert AC power current, fed from the AC power source, to DC power current; an overall-controlling section to control overall operations of the apparatus; an engine-controlling section to conduct a predetermined controlling operation among from controlling operations to be conducted in the apparatus; and a fixing section to fix a toner image on a recording medium; wherein, when the main power switch is turned ON, the DC power current generating section generates the DC power current and supplies the DC power current into both the overall-controlling section and the engine-controlling section, so as to commence to activate them; and wherein the engine-controlling section, whose initial settings are already completed, conducts a heating operation of the fixing section by employing AC power current, fed from the AC power source, and controls a preliminary operation, which does not require a completion of initial settings of the overall-controlling section, by employing the DC power current generated by the DC power current generating section; and wherein at least one of a heating time of the fixing section heated by the engine-controlling section and an operating time of the preliminary operation overlaps with a starting time of the overall-controlling section in at least a part.

(15) The apparatus of item 9, further comprising: an activating section to turn ON/OFF the DC power current; wherein, when the activating section turns ON the DC power current, the power-source controlling section controls a second DC power current outputted from the DC power current generating section.

(16) The apparatus of item 9, further comprising: an abnormality detecting section to detect an abnormality of the apparatus; wherein, when the abnormality detecting section detects none of the abnormality of the apparatus, the power-source controlling section generates the third DC power current; and wherein, when the abnormality detecting section detects none of the abnormality of the apparatus, the engine-controlling section, whose initial settings are already completed, controls the preliminary operation, which does not require a completion of the initial settings of the overall-controlling section.

(17) The apparatus of item 9, further comprising at least one of: a photoreceptor drum to form a toner image on it; a developing section to store a developing agent including toner; a polygon motor unit to irradiate and scan a laser beam onto the photoreceptor drum; a charging section, having a first electrode, to charge the photoreceptor drum; a transferring section, having a second electrode, to transfer the toner image; a separating section, having a third electrode, to separate a transfer paper from the photoreceptor drum; a accommodating section to accommodate the transfer paper; and an image-reading section to read an image on an original document; wherein the preliminary operation, which does not require the completion of the initial settings of the overall-controlling section, is at least one of: a heating temperature adjustment at the fixing section and a pre-rotating operation of a fixing roller; a toner density correction at the developing section; an operation for rotating a polygon motor at the polygon motor unit; an operation for cleaning the first electrode; an operation for cleaning the second electrode; an operation for cleaning the third electrode.; an operation for cooling an inside space of the apparatus; an operation for retuning the image-reading section to a home position; and an operation for retuning the accommodating section to a home position.

(18) The apparatus of item 3, wherein the fixing section is heated by employing an electromagnetic induction phenomenon.

(19) The apparatus of item 6, wherein a starting time, defined as a time period from a time when the main power switch or the activating section turns ON to a time when an image-forming operation is enabled, is equal to or shorter than 30 seconds.

(20) An apparatus for forming an image on a recording medium, comprising: a fixing section to fix a developed image on the recording medium by applying heat and pressure onto the developed image formed on the recording medium; peripheral load sections to conduct predetermined operations other than main image-forming operations; a system CPU to control overall sections included in the apparatus; an engine CPU to control the fixing section and the peripheral load sections; and a sub CPU, having a starting time shorter than that of the engine CPU; and wherein, when a starting time of the sub CPU has elapsed after a power source turned ON, the sub CPU commences to conduct a predetermined fixing-control operation for the fixing section.

(21) The apparatus of item 20, wherein the sub CPU finalizes the predetermined fixing-control operation for the fixing section, after initial settings of the engine CPU are completed; and wherein the engine CPU commences to conduct fixing-control operations for the fixing section at a same time when the predetermined fixing-control operation is finalized.

(22) The apparatus of item 20, wherein, when initial settings of the system CPU are completed in such a state that a fixing-control allowance signal, for allowing fixing-control operations of the fixing section, can be transmitted to the sub CPU, the system CPU transmits the fixing-control allowance signal to the sub CPU, based on an abnormality status latched at a previous operating time of the apparatus; and wherein the sub CPU conducts the predetermined fixing-control operation for the fixing section, based on the fixing-control allowance signal received from the system CPU.

According to the present invention described in the above, the following effects can be attained.

1) When the main power switch is turned on, the first and second power supply control section start operations, and the second power supply control section having been started up starts up the operating environment and engine controlling section by means of the second DC power supply output through the DC power supply. The overall controlling section starts operation by means of the second DC power supply output, after startup of the first power supply control section. Thus, when the first power supply control section has not yet started the operation but the second power supply control section has started, the engine controlling section can be started earlier than the overall controlling section, thereby reducing the influence of the overall controlling section startup time, and hence reducing the time from turning on of power to enabling of image formation.

2) When the main power switch is turned on, the first and second power supply control sections are started simultaneously. This method allows the second power supply control section to have been started earlier, and permits the engine controlling section to be started still earlier than the overall controlling section, thereby reducing the influence of the overall controlling section startup time, and hence reducing the time from turning on of power to enabling of image formation.

3) When the engine controlling section has not yet started the operation but the fix-heating section has already started, the fixing section is heated preliminarily by the fix-heating sub-control section, thereby allowing the heating of the fixing section to be started earlier. Thus, this method reduces the influence of the overall controlling section and engine controlling section startup time, and hence reduces the time from turning on of power to enabling of image formation.

4) If the temperature of the fixing section has reached a predetermined level before completion of the engine controlling section startup, the fix-heating sub-control section controls the temperature so as to maintain that temperature, until the engine controlling section starts up. If the temperature of the fixing section fails to reach a predetermined level before completion of the engine controlling section startup, the engine controlling section heats the fixing section upon completion of startup. This arrangement ensures safer heating of the fixing section.

5) The fix-heating sub-control section heats the fixing section on a preliminary basis in response to the fixing enable signal coming from the fixing enable signal generation section. This arrangement provides safe preliminary heating.

6) When the starting means is turned on, the second power supply control section generates and controls the second power supply output sent from the DC power supply section. This arrangement allows the power consumption to be reduced when the starting means is off.

7) The second power supply control section can be incorporated integrally with the engine controlling section.

8) The second power supply control section startup time does not exceed one second. This feature further reduces the time from turning on of power to enabling of image formation.

9) At least one of the time of heating the fixing section by the engine controlling section and the time of performing the preliminary operation without requiring the completion of the overall controlling section startup is overlapped at least partly with the time of starting the overall controlling section. At least one of the heating of the fixing section and preliminary operation without requiring the completion of startup of the overall controlling section is started, prior to completion of startup of the overall controlling section. This arrangement reduces the influence of the startup time of the overall controlling section, and hence cuts down the time from turning on of power to enabling of image formation.

10) When the starting means is turned on, the power supply control section generates and controls the second DC power supply output sent from the DC power supply section. This arrangement allows the power consumption to be reduced when the starting means is off.

11) When an error detecting section does not detect an error, the engine controlling section controls the heating of the fixing section and the performance of the preliminary operation without requiring the completion of the overall controlling section startup. This arrangement enables image formation with complete safety.

12) The preliminary operation, which does not require the completion of the initial settings of the overall-controlling section, can be configured as at least one of: a heating temperature adjustment at the fixing section and a pre-rotating operation of a fixing roller; a toner density correction at the developing section; an operation for rotating a polygon motor at the polygon motor unit; an operation for cleaning the first electrode; an operation for cleaning the second electrode; an operation for cleaning the third electrode; an operation for cooling an inside space of the apparatus; an operation for retuning the image-reading section to a home position; and an operation for retuning the accommodating section to a home position.

13) Since the fixing section is heated by electromagnetic induction, fixing section heating time can be cut down to ensure a substantial reduction in the time from turning on of power to enabling of image formation.

14) This arrangement ensures that the time from when the main power supply switch or startup means is turned on, until image formation is enabled, does not exceed 30 seconds.

15) After power has been turned on, predetermined fixing control is applied to the fixing section by the sub-CPU having been started before the system CPU and engine CPU startup. This arrangement advances the time for the fixing section to start fixing work, thereby reducing the influence of the system CPU startup time, and hence reducing the time from turning on of power to enabling of image formation.

16) After the engine CPU has started, the sub-CPU terminates predetermined fixing control over the fixing section and the engine CPU starts the fixing control of the fixing section. Thus, safe fixing control is provided by the engine CPU. At the same time, the time from turning on of power to enabling of image formation is reduced by fixing under sub-CPU control.

17) According to the fixing control allowance signal, the sub-CPU applies predetermined fixing control to the fixing section. This arrangement allows fixed control to be provided with complete safety by the sub-CPU, in response to the fixing control allowance signal.

BRIEF DESCRIPTION OF THE DRAWINGS

Other objects and advantages of the present invention will become apparent upon reading the following detailed description and upon reference to the drawings in which.

DETAILED DESCRIPTION OF THE PREFERRED EMBODIMENT

Figure 1:
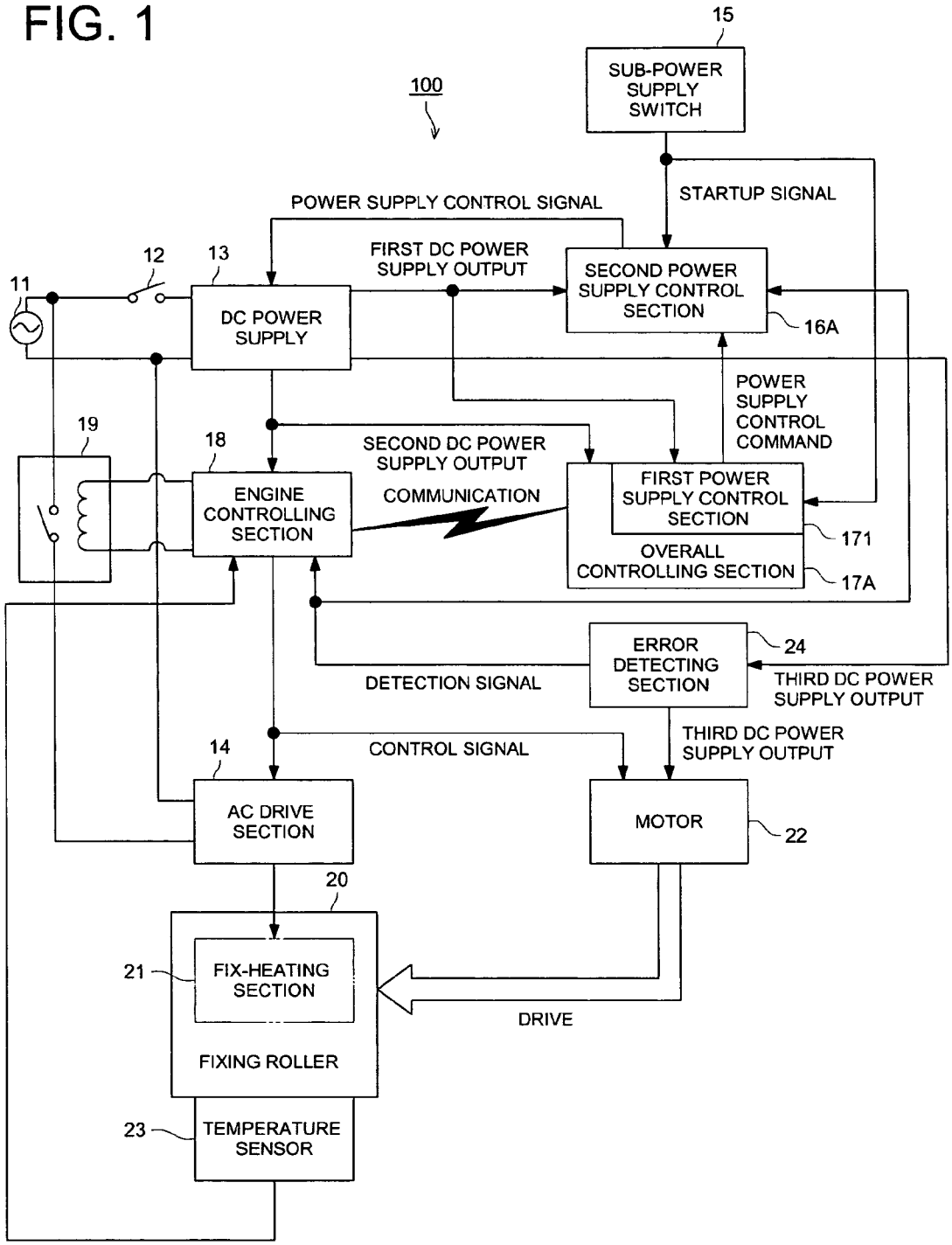
FIG. 1 is a block diagram representing the control configuration of a copying machine 100 as a first embodiment of the present invention.

Referring to the drawings, the following describes the first through third embodiments of the present invention, without the scope of the invention being restricted to the illustrated examples:

[Embodiment 1]

Figure 2:
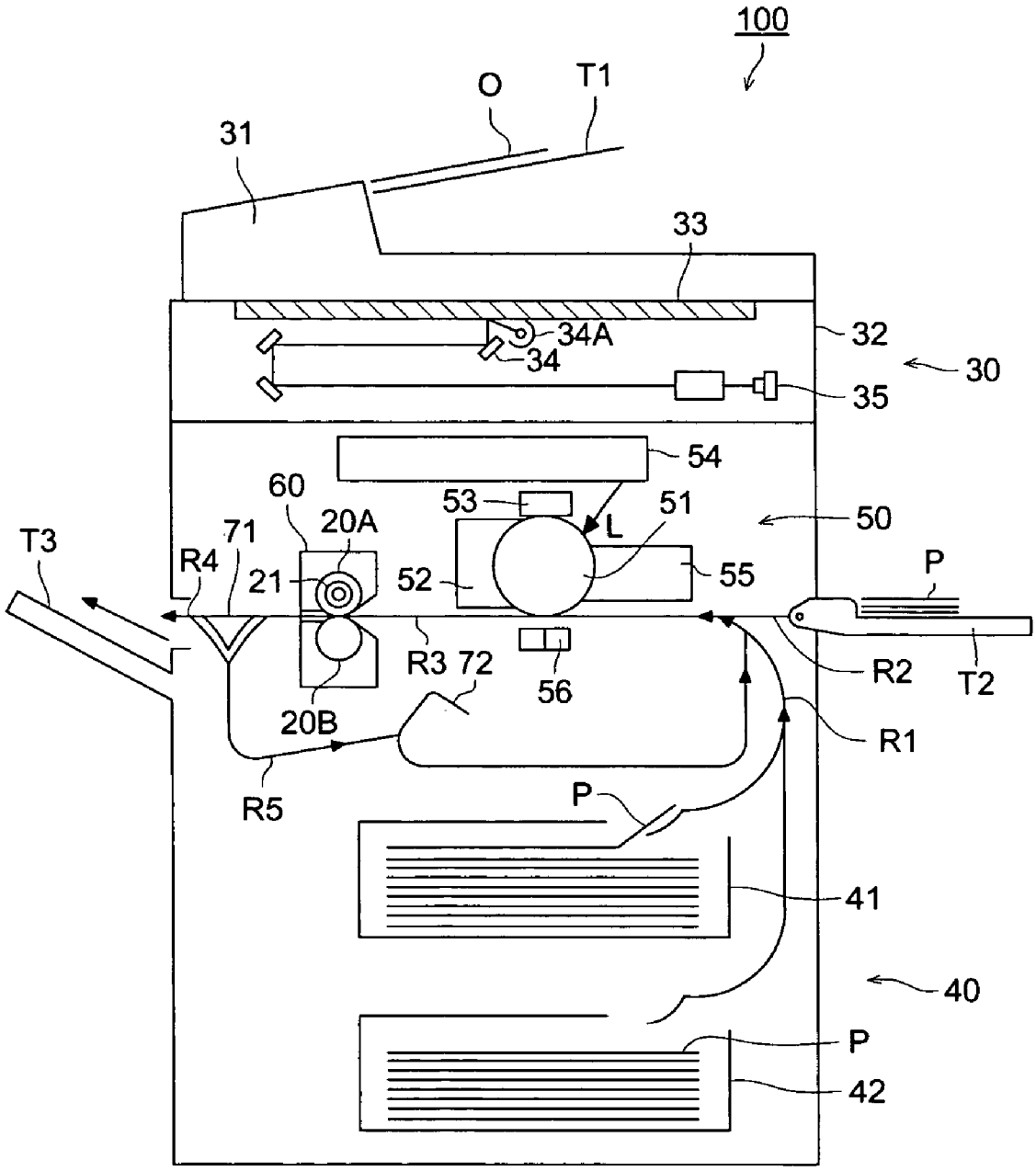
FIG. 2 is a drawing representing the overall arrangement of the copying machine 100.

With reference to FIGS. 1 through 4, the first embodiment of the present invention will be described. In the first place, the features of the apparatus as an embodiment of the present invention will be shown, with reference to FIGS. 1 and 2. FIG. 1 shows the control configuration of the copying machine 100 as the present embodiment. FIG. 2 shows the overall arrangement of the copying machine 100.

As shown in FIG. 1, the copying machine 100 as an image forming apparatus comprises an AC power supply 11, main power supply switch 12, DC power supply 13, AC drive section 14, sub-power supply switch 15, second power supply control section 16A, overall controlling section 17A, engine controlling section 18, main relay 19, fixing roller 20, fix-heating section 21, motor 22, temperature sensor 23 and error detecting section 24. Further, the overall controlling section 17A includes the first power supply control section 171.

The AC power supply 11 supplies AC supply power. The main power supply switch 12 is used by the operator to turn on or off the AC supply power to the DC power supply 13 from the AC power supply 11. The DC power supply 13 converts the AC supply power inputted from the AC power supply 11, and delivers the DC power supply output as, the first DC power supply output to the first power supply control section 171 and second power supply control section 16A. Further, the DC power supply 13 generates the appropriate DC power supply output as the second DC power supply output, in response to the power supply control signal inputted from the second power supply control section 16A, and sends it to the overall controlling section 17A and engine controlling section 18. In response to the power supply control signal inputted from the second power supply control section 16A, the DC power supply 13 also generates the appropriate DC power supply output as the third DC power supply output and delivers it to the motor 22 and the like.

Using the control signal inputted from the engine controlling section 18 and AC supply power inputted from the AC power supply 11, the AC drive section 14 generates the heating power for driving the fix-heating section 21, and delivers it to the fix-heating section 21. The sub-power supply switch 15 is a power switch of the operation panel or the like, and delivers the startup signal to the first power supply control section 171 and second power supply control section 16A when turned on by the operator. When the main power supply switch 12 is on and the sub-power supply switch 15 is also turned on, the copying machine 100 is started to get ready for image formation.

The second power supply control section 16A is a power supply control section operated before the overall controlling section 17A is started. In response to the start signal inputted from the sub-power supply switch 15, the detection signal inputted from the error detecting section 24, power supply control signal inputted from the first power supply control section 171 and preset setting conditions, the second power supply control section 16A generates the power supply control signal and delivers it to the DC power supply 13. The second and third DC power supply outputs outputted from the DC power supply 13 through the power supply control signal outputted from the second power supply control section 16A is placed under control.

The overall controlling section 17A controls overall operations such as creation of an image page for image formation based on the second DC power supply output delivered from the DC power supply 13, the page management, and communication management with the external equipment (not illustrated). The overall controlling section 17A also performs communication with the engine controlling section 18 and manages various forms of control in the engine controlling section 18. With the first DC power supply output inputted from the DC power supply 13, the first power supply control section 171 generates and outputs the power supply control command, in response to the start signal inputted from the sub-power supply switch 15 and inputs it into the second power supply control section 16A.

The engine controlling section 18 provides on/off control of the main relay 19, and controls the fixing device and sheet feed system (not illustrated). The engine controlling section 17B generates the temperature detection signal inputted from the temperature sensor 23, the detection signal inputted from the error detecting section 24 and the control signal based on the second DC power supply output inputted from the DC power supply 13, and delivers them to the AC drive section 14, motor 22 and others.

The overall controlling section 17A and engine controlling section 18 provide control by scanning and running various control programs from a memory (not illustrated). The program for overall control is large-sized. Especially when the copying machine 100 is multifunctional, the program is complicated and has a large capacity. Thus, the overall controlling section 17A startup time requires a few seconds through several tens of seconds. By contrast, the engine controlling section 18 controls drive of the motor 22 and others that do not take much time, and is configured in a simpler configuration. Accordingly, the startup time of the engine controlling section 18 does not exceed 1 second, for example.

The main relay 19 turns on or off the power to the AC drive section 14 of the AC supply power inputted from the AC power supply 11. The fixing roller 20 applies heat and pressure to the recording medium with unfixed toner image formed thereon, by the photoconductor drum 51 to be described later. The fix-heating section 21 is composed of an electromagnetic induction heating coil and outputs the magnetic flux based on the heating power inputted from the AC drive section 14. It applies heat by the loss by Joulian heat of the eddy current generated when the magnetic flux is applied to a heating roller 20A to be described later. When a halogen heater is used as a fix-heating section, the time of heating the fixing roller 20 to a predetermined temperature is as long as five minutes, for example. By contrast, heating time by the fix-heating section 21 using an induction heating coil is only about 30 seconds, for example.

The third DC power supply output is inputted to the motor 22 from the DC power supply 13 and the fixing roller 20 is turned. The preliminary operation without requiring the completion of the overall controlling section 17A startup includes correction of the preliminary rotation of the fixing roller 20 by the motor 22.

The temperature sensor 23 detects the temperature of the fixing roller 20 and outputs the temperature detection signal to the engine controlling section 18. The error detecting section 24 checks if the outer cover (door) of the copying machine 100 is interlocked or not (if the cover is opened or not). It also checks for various errors such as paper jamming, and outputs the detection signal to the engine controlling section 18 and second power supply control section 16A. If the third DC power supply output is inputted from the DC power supply 13 without interlock or error, the error detecting section 24 outputs the third DC power supply output to the motor 22 and others.

Referring to FIG. 2, the following describes the overall configuration of the copying machine 100. The copying machine 100 comprises a reading section 30, sheet feed section 40, image forming section 50 and fixing device 60. The reading section 30 includes an ADF (automatic document feed apparatus) 31 and scanner 32. The ADF 31 is equipped with a document tray T1. The scanner 32 is provided with a platen glass 33 and a scanning section 34 consisting of a light source 34A, reflecting mirror and CCD (charge coupled device) 35.

In the reading section 30, the document with an image formed thereon is placed on the platen glass 33 and the scanning section 34 (light source 34A) moves so as to scan the document. The light applied from the light source 34A is reflected by the document and the analog image signal corresponding to the image of the document is read by photoelectric conversion of the CCD 35 from the reflected light. The analog image signal is subjected to image processing in the read processing section (not illustrated), whereby the digital image data is acquired. In the image reading section 30, the document O set on the document tray T1 can be automatically fed on the platen glass 33 by the ADF 31. It is also possible to arrange such a configuration that a CCD image sensor 35 is incorporated in the scanning section 34 and the CCD image sensor 35 also moves at the time of scanning.

The sheet feed section 40 is equipped with sheet feed trays 41 and 42 that feed the recording paper (transfer sheet). One or three sheet feed trays may be provided. The copying machine 100 is provided with a manual feed tray for the user to feed sheets manually.

The image forming section 50 is a laser based image forming section, and forms an image data on the recording sheet. The image forming section 50 comprises a photoconductor drum 51, cleaner 52, charging device 53, exposure section 54, development section 55 and transfer section 56. The transfer section 56 is equipped with a transfer section and a separation section.

The fixing device 60 has fixing rollers 20 consisting of a heating roller 20A as a heating member for heating the recording sheet and pressure roller 20B. The heating roller 20A and pressure roller 20B are pressed to constitute a nip portion. The fix-heating section 21 as an induction coil is incorporated inside the heating roller 20A. The fix-heating section 21 generates magnetic flux when power is supplied and the magnetic flux is applied to the heating roller 20A. The loss by Joulian heat of the eddy current produced on the surface causes the heating roller 20A to generate heat.

When image printing is performed, a recording sheet P is supplied to the photoconductor drum 51 from the sheet feed trays 41 and 42 through the conveyance path R1 by the overall controlling section 17A and engine controlling section 18. Alternatively, a recording sheet P is supplied to the photoconductor drum 51 from the manual feed tray T2 through the conveyance path R2. In the image forming section 50, the photoconductor drum 51 is rotated and the surface of the photoconductor drum 51 is charged by the charging device 53. An electrostatic latent image corresponding to the image data to be printed is formed, when laser beam is applied by the exposure section 54. Toner is attached to the electrostatic latent image by a development section 55 containing the developer including toner. A toner image is transferred onto the recording sheet P by the transfer means of the transfer section 56, and the recording sheet P with the toner image transferred thereon is separated from the photoconductor drum 51 by the separation means of the transfer section 56. Toner remaining on the photoconductor drum 51 is removed by the cleaner 52.

The recording sheet P with a toner image formed thereon is fed to the fixing device 60 through the conveyance path R3. The fixing device 60 applies heat and pressure to the toner image on the recording sheet, whereby an image is formed. To put it more specifically, heat and pressure are applied to the recording sheet P with a toner image formed thereon when this sheet passes through the nip portion between the heating roller 20A rotated by the motor 22 and heated by the fix-heating section 21 and the pressure roller 20B. Then the unfixed toner image is fixed on the recording sheet. The recording sheet P with an image formed thereon is fed to the ejection tray T3 through the conveyance path R4 and is ejected. In the case of a duplex printing, the recording sheet P with an image printed on one side is fed out to the conveyance path R5 by a separation device 71 and is reversed by a reversing section 72. The sheet is again fed to the photoconductor drum 51 and an image is formed on the reversed side.

Under the control of the overall controlling section 17A and engine controlling section 18, the temperature (of the heating roller 20A) of the fixing roller 20 is detected by the temperature sensor 23, and control is so provided that the fixing roller 20 is maintained at the appropriate temperature. The recording sheet is fed along the conveyance paths R1 through R5 by the conveyance roller (not illustrated). In FIGS. 1 and 2, a means for communication with an external device such as a PC and others are omitted from the copying machine 100.

Figure 3:
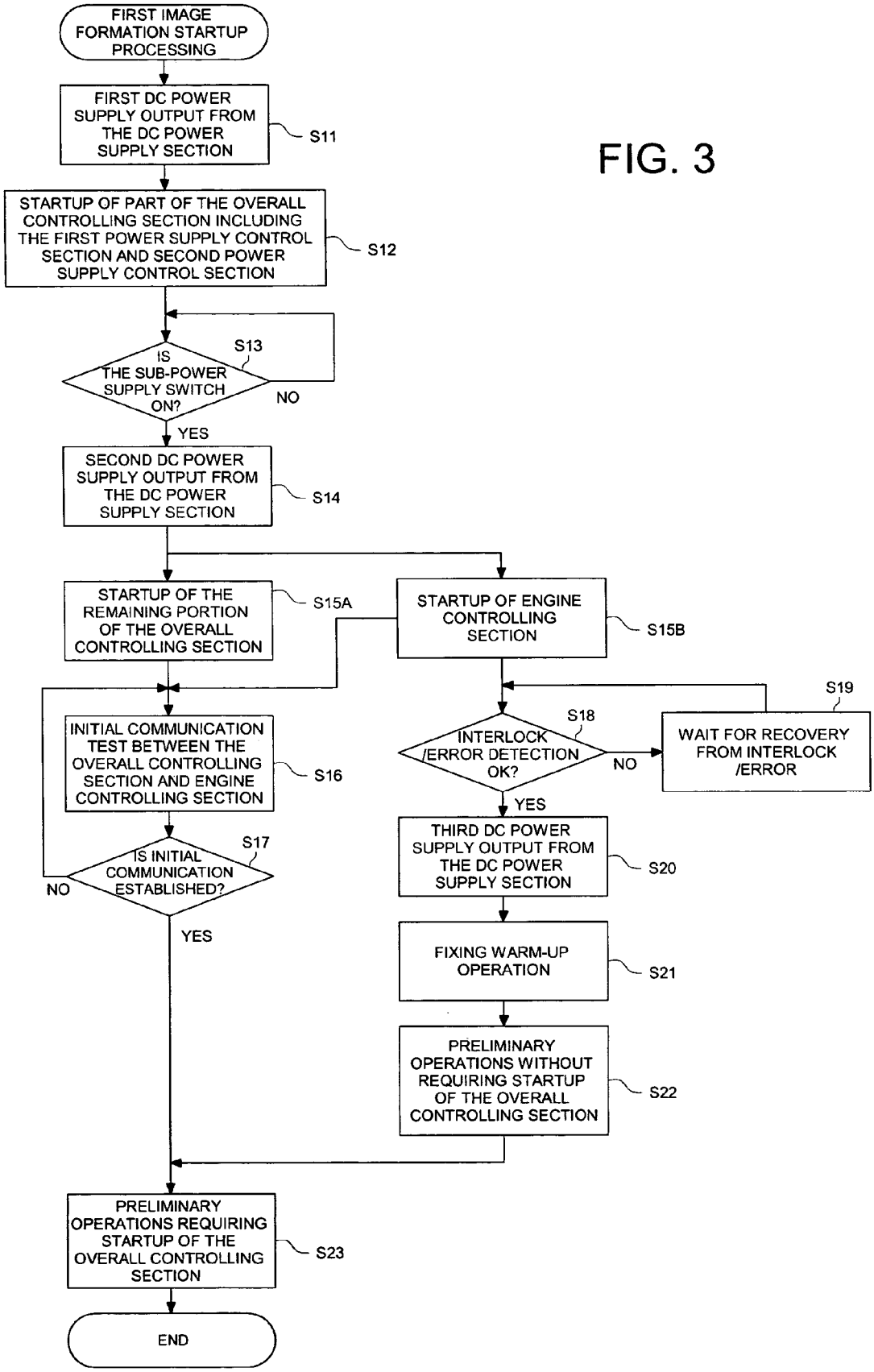
FIG. 3 is a flowchart showing first image formation startup processing.
Figure 4:
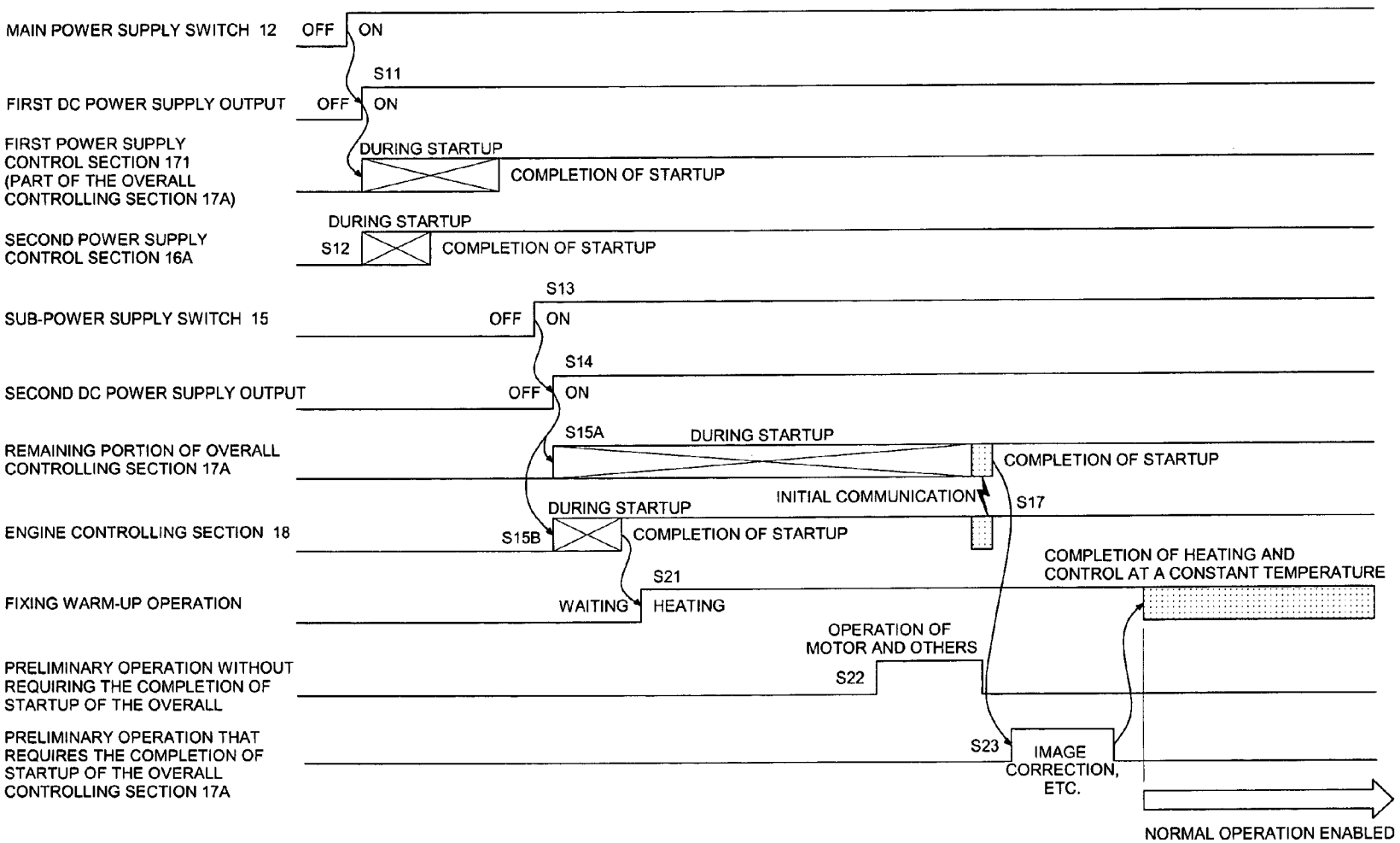
FIG. 4 is a timing chart showing first image formation startup processing.

Referring to FIGS. 3 and 4, the operation of the copying machine 100 will be described. FIG. 3 shows the first image formation startup processing, and FIG. 4 is a timing chart showing first image formation startup processing. The reference numerals of the corresponding steps are given in the timing chart of FIG. 4.

In the first image formation startup processing, when the main power supply switch 12 and sub-power supply switch 15 of the copying machine 100 are turned on, the overall controlling section 17A and engine controlling section 18 are started, and various forms of preliminary operations are activated in such a way that the normal image forming operations are enabled.

Various forms of preliminary operations consist of the preliminary operations that do not require startup of the overall controlling section 17A and the preliminary operations that require startup of the overall controlling section 17A. The preliminary operations that do not require startup of the overall controlling section 17A include the steps of:

correcting the preliminary rotation of the fixing roller 20 by the motor 22;

adjusting the heating temperature of the fixing roller 20 using the temperature detecting signal of the temperature sensor 23;

correcting the toner density in the development section 55;

rotating the polygon motor (not illustrated) wherein a laser beam is applied for scanning to the photoconductor drum 51 in the exposure section 54;

cleaning the electrode of the charging device 53 by a cleaning means (not illustrated);

cleaning the electrode of the transfer means of the transfer section 56 by a cleaning means (not illustrated);

cleaning the electrode of the separation means of the transfer section 56 by a cleaning means (not illustrated);

cooling inside the copying machine 100 by a fan as a cooling means (not illustrated);

returning of the scanning section 34 of the reading section 30, to the home position; and returning of the sheet feed trays 41 and 42 as storage means for storing recording sheets P, to the home position.

The third DC power supply output to be described later is applied to the sections for performing the preliminary operations that do not require startup of the overall controlling section 17A, and the preliminary operations are. performed.

The preliminary operations that require startup of the overall controlling section 17A include detection and correction of the toner density involving formation of an image on the photoconductor drum 51 by the overall controlling section 17A, and correction of shading of the CCD image sensor 35 of the reading section 30.

As shown in FIGS. 3 and 4, when the main power supply switch 12 has been turned on in the copying machine 100, the first image formation startup processing is carried out. In the first place, the AC supply power outputted from the AC power supply 11 is converted by the DC power supply 13 and is delivered as the first DC power supply output to the first power supply control section 171 and second power supply control section 16A (Step S11). Part of the overall controlling section 17A including the first power supply control section 171 and the second power supply control section 16A are started by the first DC power supply output (Step S12). Evaluation is made to determine whether or not the sub-power supply switch 15 is turned on by the operator (Step S13).

When the sub-power supply switch 15 is not turned on (NO in Step S13), the system goes to the Step S13. When the sub-power supply switch 15 is turned on (YES in Step S13), the startup signal is issued from the sub-power supply switch 15 and is inputted to the first power supply control section 171 and second power supply control section 16A. When the startup signal has been inputted, the power control signal is generated and outputted according to a predetermined setting conditions set in advance from the second power supply control section 16A and is inputted into the DC power supply 13. When the power control signal has been inputted, the second DC power supply output is generated and outputted by the DC power supply 13 and is inputted into the overall controlling section 17A and engine controlling section 18 (Step S14). In Step S14, communication between overall controlling section 17A and engine controlling section 18 is not yet established and the status information on the engine controlling section 18 cannot be obtained on the overall controlling section 17A. Accordingly, the first power supply control section 171 does not provide power supply control of the DC power supply 13.

When the second DC power supply output has been inputted, the rest of the overall controlling section 17A except for part of the overall controlling section 17A including the first power supply control section 171 is started and executed (Step S15A). In parallel with Step S15A, the engine controlling section 18 is started and executed (Step S15B) when the second DC power supply output has been inputted. When at least one of the Steps S15A and S15B has been executed, initial communication is tried between the overall controlling section 17A and engine controlling section 18 (Step S16). Normally, the time required for startup of the engine controlling section 18 in Step S15B is shorter than the remaining time required for startup of the overall controlling section 17A in Step S15A, as shown in FIG. 4.

Evaluation is made to determine whether or not initial communication has been established between the overall controlling section 17A and engine controlling section 18 (Step S17). In order for initial communication to be established between the overall controlling section 17A and engine controlling section 18, both the overall controlling section 17A and engine controlling section 18 must have been executed. If initial communication has been executed (NO in Step S17), the system goes to Step S16.

When the startup of the engine controlling section 18 in the Step S15B has been completed, evaluation is made by the engine controlling section 18 to determine whether or not detection is made by in the error detecting section 24 to verify that there is no error such as a paper jam and the cover and others of the copying machine 100 is interlocked (Step S18). If detection cannot be made to verify that there is no error at all (NO in Step S18), some of the errors are detected, and waiting for closure of the cover and others by the operator or waiting for recovery from an error is executed (Step S19). Then the system proceeds to the Step S18. In Steps S18 and S19, an error presence/absence detection signal is generated and outputted by the error detecting section 24, and is sent to the engine controlling section 18 or second power supply control section 16A.

If it has been verified that there is no error at all (YES in Step S18), the power supply control signal is generated and outputted by the second power supply control section 16A, according to the detection signal for indicating a no-error condition, inputted from the error detecting section 24, and is inputted into the DC power supply 13. In response to the power supply control signal inputted from the second power supply control section 16A, the third DC power supply output is generated by the DC power supply 13 and is inputted into the motor 22 (Step S20). The main relay 19 is turned on by the engine controlling section 18, and the AC supply power outputted from the AC power supply 11 is inputted to the AC drive section 14. At the same time, the control signal is outputted from the engine controlling section 18 and is inputted into the AC drive section 14 and motor 22. When the AC supply power and control signal are inputted, the AC heating power is generated and outputted by the AC drive section 14 and is inputted to the fix-heating section (induction coil) 21. Then the (heating roller 20A of) the fixing roller 20 is heated by the fix-heating section 21, and warm-up operation is performed (Step S21).

The preliminary operations without requiring the completion of the startup of the overall controlling section 17A, such as correction of the preliminary rotation of the motor 22 with control signal and third DC power supply output inputted therein, are carried out by the engine controlling section 18 (Step S22). When the initial communication has been established (YES in Step S17), the preliminary operation that requires the completion of the startup of the overall controlling section 17A is carried out by the overall controlling section 17A (Step S23). This will terminates the first image formation startup processing.

Further, when the initial communication has been established, the first power supply control section 171 generates and outputs a power supply control command and inputs it into the second power supply control section 16A. In response to this power supply control command, the second power supply control section 16A generates and outputs the power supply control signal and inputs it into the DC power supply 13. For example, when the sub-power supply switch 15 is turned off, the first power supply control section 171 generates the shutdown command and inputs it into the second power supply control section 16A. Then the second power supply control section 16A generates the shutdown control command and inputs it into the DC power supply 13.

When the main power supply switch 12 is turned on and the sub-power supply switch 15 is turned off, the system is put into the image formation wait mode. For example, only a part of overall controlling section 17A including the first power supply control section 171 is started, and only the control related to the wait status for the management of communication with an external device is provided. In this wait mode, not all portions of the overall controlling section 17A is started, and heating of the fixing device 60 is not carried out. This arrangement contributes to power saving.

After execution of the Step S21, the temperature of the fixing roller 20 is detected by the temperature sensor 23, and the temperature detection signal is inputted into the engine controlling section 18. The control signal inputted into the AC drive section 14 is adjusted by the engine controlling section 18 according to the temperature detection signal, and the heating power, outputted from the AC drive section 14 and inputted into the fix-heating section 21, is adjusted, whereby the temperature on the surface of the fixing roller 20 is kept at an appropriate temperature.

According to the present embodiment, when the main power supply switch 12 is turned on, the second power supply control section 16A is started. The second power supply control section 16A having been started starts the overall controlling section 17A and engine controlling section 18. The engine controlling section 18 having been started controls the power supplied to the fix-heating section 21 through the AC drive section 14. Using the third DC power supply output of the DC power supply 13, the engine controlling section 18 controls the preliminary operation without requiring the completion of the startup of the overall controlling section 17A. Accordingly, the electric conduction (heating) of the fixing device 60 and execution of the preliminary operation without requiring the completion of startup of the overall controlling section 17A can be achieved earlier than the completion of startup of the overall controlling section 17A. This arrangement reduces the influence of the startup time of the overall controlling section 17A, and hence cuts down the time from turning on of power to enabling of image formation.

Since the overall controlling section 17A and engine controlling section 18 are started simultaneously, starting of the engine controlling section 18 can be completed earlier. This arrangement reduces the influence of the startup time of the overall controlling section 17A, and hence cuts down the time from turning on of power to enabling of image formation.

To put it another way, at least one of the time of heating the fixing device 60 by the engine controlling section 18 and the time of performing the preliminary operation without requiring the completion of startup of the overall controlling section 17A is overlapped at least partly with the time of starting the overall controlling section 17A. At least one of the heating of the fixing device 60 and preliminary operation without requiring the completion of startup of the overall controlling section 17A is started, prior to completion of startup of the overall controlling section 17A. This arrangement reduces the influence of the startup time of the overall controlling section 17A, and hence cuts down the time from turning on of power to enabling of image formation.

When the sub-power supply switch 15 is turned on, the second power supply control section 16A generates and controls the second DC power supply output issued from the DC power supply 13. This arrangement reduces the power consumption when the sub-power supply switch 15 is off.

When the error detecting section 24 does not detect an error, heating of the fixing roller 20 by the engine controlling section 18 and performance of the preliminary operation without requiring the completion of startup of the overall controlling section 17A are placed under control. This arrangement enables image formation with complete safety.

(The heating roller 20A) of the fixing roller 20 is heated by the fix-heating section 21 according to the electromagnetic induction method. This arrangement allows the fixing device heating time to be cut down to ensure a substantial reduction in the time from turning on of power to enabling of image formation.

It is stipulated in the laws and regulations in Japan that the time for getting back to the mode of enabling the image formation from the power save mode should not exceed 30 seconds for the purpose of energy conservation, and it is preferred to provide an image forming apparatus meeting this requirement. According to the configuration of the present embodiment, the influence of the startup time of the overall controlling section 17A is reduced, and the time from turning on of the main power supply switch 12 or sub-power supply switch 15 to enabling of image formation can be easily kept below 30 seconds.

[Embodiment 2]

Figure 5:
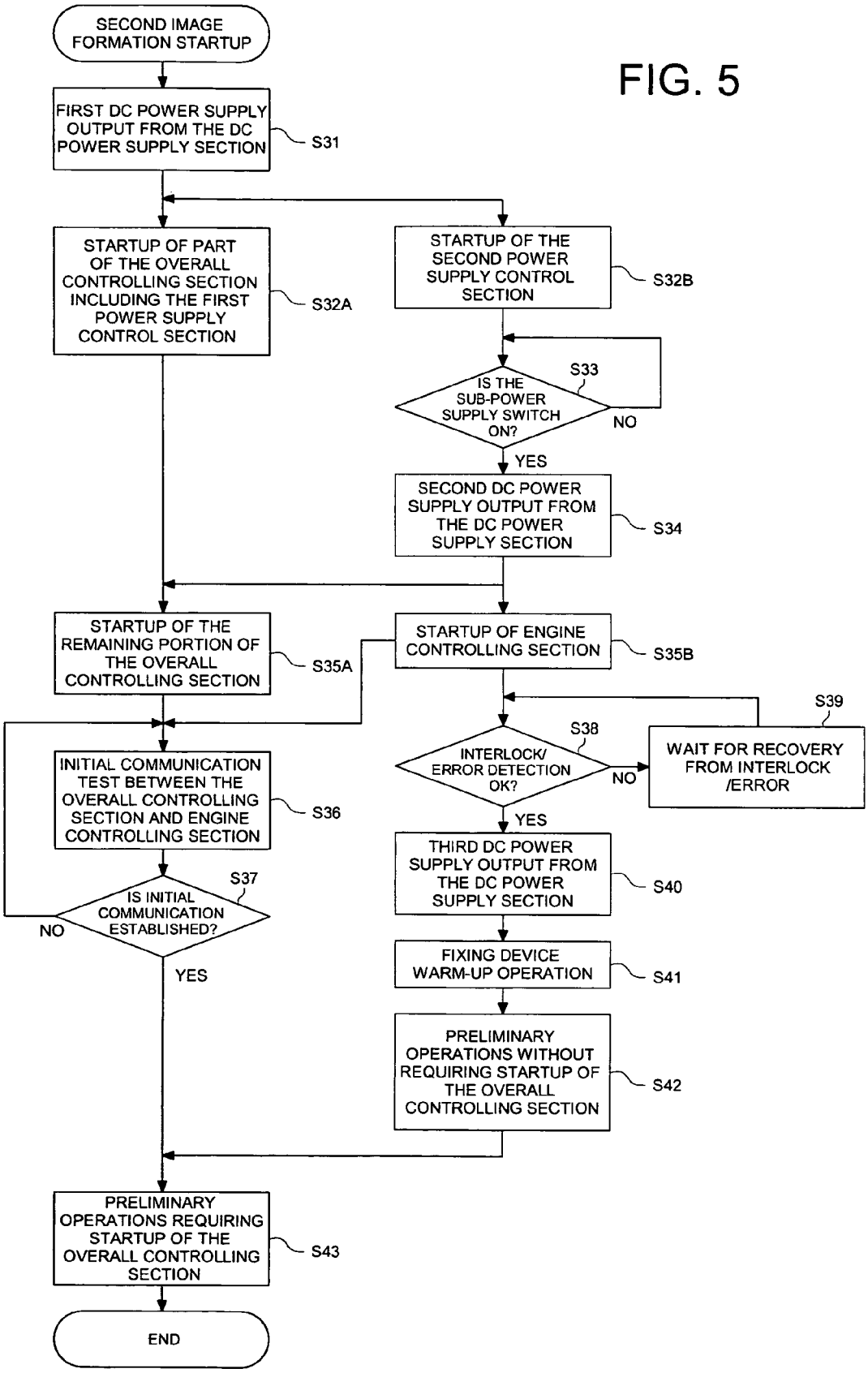
FIG. 5 is a flowchart showing second image formation startup processing.
Figure 6:
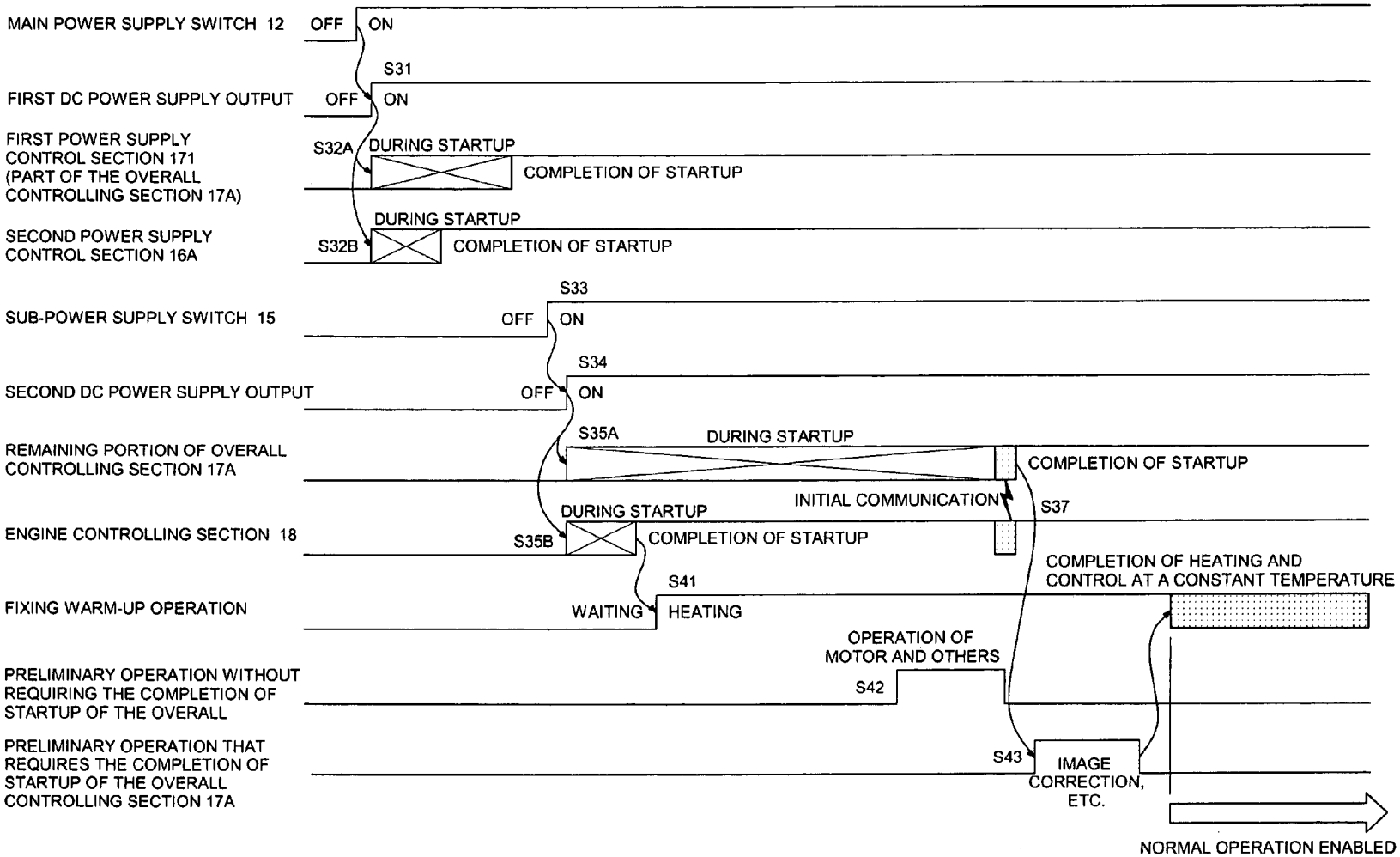
FIG. 6 is a timing chart showing second image formation startup processing.
Figure 7:
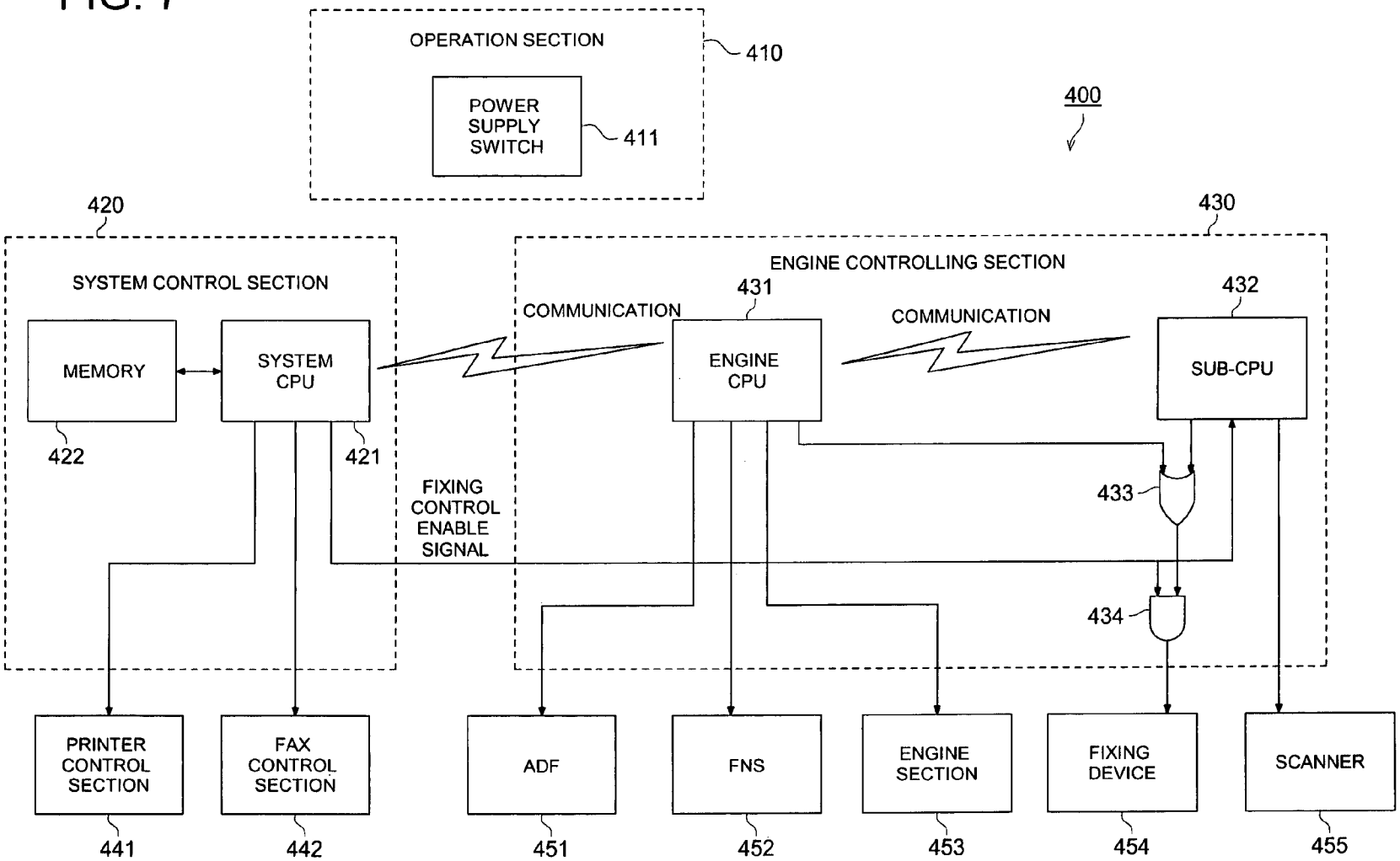
FIG. 7 is a block diagram representing the internal configuration of the copying machine 100 as an embodiment of the present invention.

Referring to FIGS. 5 and 6, the following describes the second embodiment of the present invention. FIG. 7 is a timing chart representing the second image formation startup processing. The timing chart of FIG. 7 contains the reference numbers of corresponding steps.

Many of the portions in this embodiment are shared by those in the first embodiment. The following describes the present embodiment with particular reference to the differences from the first embodiment. For the explanation of the present embodiment, the copying machine 100 of the first embodiment will be used.

Then the second image formation startup processing as the operation of the copying machine 100 will be described. The second image formation startup processing as is the same as the first image formation startup processing, the only difference being found in the processing of the portions where the overall controlling section 17A including the first power supply control section 171 and the second power supply control section 16A are started up in parallel. As shown in FIGS. 5 and 6, triggered by the main power supply switch 12 being turned on, the second image formation startup processing is started in the copying machine 100.

In the first place, the Step S31 is executed. Step S31 is the same as the first image formation startup processing S11 of FIG. 3. Part of the overall controlling section 17A including the first power supply control section 171 is started and executed by the first DC power supply output (Step S32A). In parallel with the Step S32A, the second power supply control section 16A is started and executed by the first DC power supply output (Step S32B).

Upon completion of the startup of the second power supply control section 16A, the Steps S33 and S34 are executed sequentially. The Steps S33 and S34 are the same as the Steps S13 and S14 of the first image formation startup processing. When the second DC power supply output has been inputted after execution of the Step S34, the engine controlling section 18 is started up (Step S35B). Further, the remaining portion of the overall controlling section 17A, except for part of the first power supply control section 171, is started up by the input of the second DC power supply output, subsequent to execution of the Step S34 when the part of the overall controlling section 17A including the first power supply control section 171 has been started up (Step S35A). Normally, if the sub-power supply switch 15 is quickly turned on, the time required for startup of the second power supply control section 16A in Step S32B is shorter than the time required for startup of part of the overall controlling section 17A including the first power supply control section 171 in Step S32A, as shown in FIG. 6. Thus, the Step S35B is executed earlier than the Step S35A. It is preferred that the time required for completion of startup of the second power supply control section 16A do not exceed 1 second, and the Step S35B be executed earlier than the Step S35A.

Then Steps S36 through S43 are executed and the second image formation startup processing terminates. Steps S36 through S43 are the same as Steps S16 through S23, respectively.

According to the present embodiment, when the main power supply switch 12 is on, (part of the overall controlling section 17A including) the first power supply control section 171 and the second power supply control section 16A start the engine controlling section 18 by the second DC power supply output through the DC power supply 13. After completion of startup of the first power supply control section 171, the remaining portion of the overall controlling section 17A is started by the second DC power supply output. Accordingly, when the first power supply control section 171 is not started and the second power supply control section 16A has started, the engine controlling section 18 is started earlier than the overall controlling section 17A. This arrangement reduces the influence of the startup time of the overall controlling section 17A, and hence cuts down the time from turning on of power to enabling of image formation.

When the main power supply switch 12 is on, the first power supply control section 171 and second power supply control section 16A are started in parallel. Accordingly, the second power supply control section 16A can be started earlier and the engine controlling section 18 can be started still earlier than the overall controlling section 17A. This arrangement reduces the influence of the startup time of the overall controlling section 17A, and hence cuts down the time from turning on of power to enabling of image formation.

When the time of starting second power supply control section 16A is set not to exceed 1 second, the time from turning on of power to enabling of image formation can be further reduced.

Referring to the drawings, the following describes the third embodiment of the present invention, without the present invention being restricted to-the illustrated examples:

The following describes the features of the apparatus of the present embodiment with reference to FIG. 7. FIG. 7 shows the internal configuration of the copying machine 400 of the present embodiment.

As shown in FIG. 7, the image forming apparatus as a copying machine 400 includes: an operation section 410 for receiving the operation input by a user; a system control section 420 for overall status management of the copying machine 400; an engine controlling section 430 for controlling sheet feed, fixing and others; a printer control section 441 and a FAX control section 442 controlled by the system control section 420; an ADF (automatic document feed apparatus) 451 controlled by the engine controlling section 430; an FNS (Finisher) 452; an engine section 453; a fixing device 454; and a scanner 455.

The operation section 410 is equipped with a power supply switch 411. The system control section 420 contains a system CPU 421 and a memory 422. The engine controlling section 430 has an engine CPU 431, a sub-CPU 432, an OR circuit 433 and an AND circuit 434.

The power supply switch 411 switches the on-off operation for supply power into the copying machine 400 from the main power supply (not illustrated) in response to the user's operation. The power supply switch 411 is a main power switch, for example. However, it may include the sub-power supply switch on the operation panel. When this sub-power supply switch is included, power is turned on if the sub-power supply switch is turned on with the main power supply switch kept on.

The system CPU 421 is started when power is turned on by the power supply switch 411. It reads a boot program and application program from a program memory (not illustrated) and stores them in a RAM (not illustrated). Various forms of processing are performed in collaboration with the boot program and application program in the RAM. After completion of startup, the system CPU 421 establishes communication with the engine CPU 431 to place the engine CPU 431 under its management. Further, in collaboration with the boot program, the system CPU 421 generates the fixing control allowance signal and sends it to the sub-CPU 432. After completion of startup, the system CPU 421 controls the printer control section 441 and the FAX control section 442. The memory 422 stores the data so that it can be read and written. Further, the memory 422 at least stores the error latch information that indicates whether or not any error occurred when the power supply switch 411 was last turned off.

The engine CPU 431 reads various programs from a program memory (not illustrated) and stores them into a RAM (not illustrated). It performs various forms of processing in collaboration with various programs in the RAM. After completion of startup, the engine CPU 431 establishes communication with the system CPU 421 and the sub-CPU 432. After completion of startup, the engine CPU 431 places the FNS 452 and engine section 453 under its control. After completion of startup, the engine CPU 431 also generates the control signal of the fixing device 454 and inputs it into the OR circuit 433.

The sub-CPU 432 reads a predetermined fixing program and scanning program, and stores them into a RAM (not illustrated). It performs processing of fixing and scanning in collaboration with the fixing program and scanning program stored in the RAM. After completion of startup, the Sub-CPU 432 establishes communication with the engine CPU 431. After completion of startup, the sub-CPU 432 generates the predetermined control signal of the fixing device 454 according to the fixing control allowance signal inputted from the system CPU 421 and sends it to the OR circuit 433. Further, after completion of startup, the sub-CPU 432 places the scanner 445 under its control.

The startup time from start of the system CPU 421 to completion of startup is several tens of seconds in terms of a boot program, and about 6 through 7 seconds in terms of the application program. The startup time of the engine CPU 431 is about 2 through 3 seconds. The startup time of the sub-CPU 432 is several tens of seconds, for example. To put it another way, the startup time of the sub-CPU 432 is very short. This is followed by the startup time of the engine CPU 431 and then by the startup time of the system CPU 421, which is the longest.

The OR circuit 433 inputs into the AND circuit 434 the control signals the sum of the control signals inputted from the engine CPU 431 and sub-CPU 432. The AND circuit 433 inputs into the fixing device 454 the control signal as a product between the control signal inputted from the OR circuit 433 and the fixing control allowance signal.

In response to the control signal inputted from the system CPU 421, the printer control section 441 performs various forms of control, including that of the image formation, related to the printer section (not illustrated) in the copying machine 400. According to the control signal inputted from the system CPU 421 the FAX control section 442 performs various forms of control, including that of the image formation, related to the FAX section (not illustrated) in the copying machine 400.

In response to the control signal inputted from the engine CPU 431, the ADF 451 feeds the document when scanner 445 reads an image. In response to the control signal inputted from the engine CPU 431, the FNS 452 performs processing such as sorting of the recording sheets with an image formed thereon. In response to the control signal inputted from the CPU 431, the engine section 453 performs such processing as conveyance of the recording sheet by the conveyance roller at the time of image formation, and driving of the photoconductor drum, charging device, light source, exposure device or the like (not illustrated).

In response to the control signal inputted from the CPU 431, the fixing device 454 applies heat and pressure to the recording sheet with an image formed thereon, and transfers it. The fixing device 454 consists of a fixing roller for applying pressure to the recording sheet, a fixing heater for heating the fixing roller, and a temperature sensor for detecting the temperature on the surface of the fixing roller. Further, an electromagnetic induction heater (IH) or a halogen heater can be used as the heater of the scanner fixing device 454.

The scanner 455 incorporates a CCD (charge coupled device) as an image reading means and drive means. Based on the control signal inputted from the CPU 431, it reads the image recorded on the document by the CCD drive, as image data.

Figure 8:
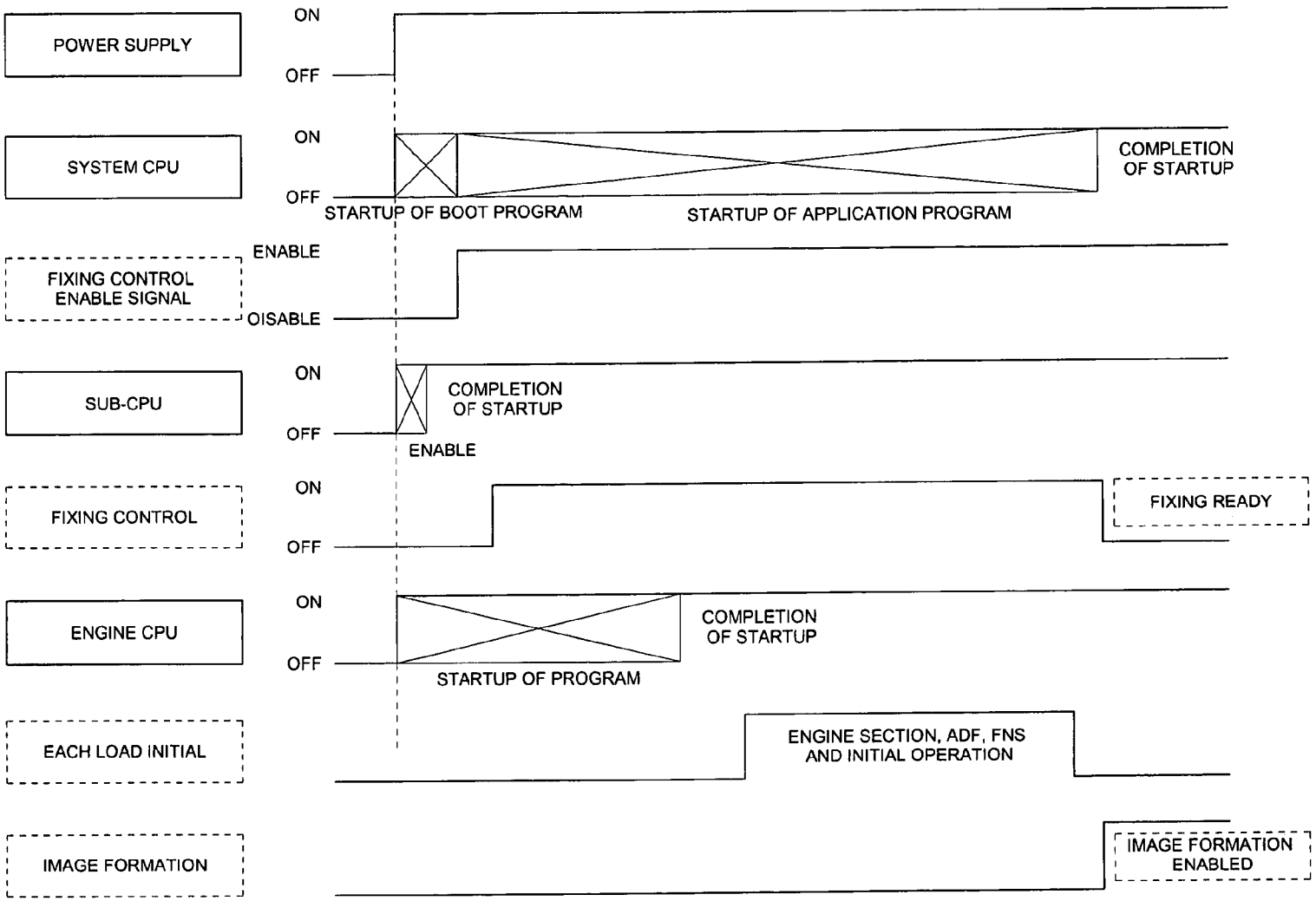
FIG. 8 is a timing chart of various signals when the copying machine 100 is started.

Referring to FIG. 8, the following describes the startup operation of the copying machine 400. FIG. 8 is a timing chart representing various statuses in the startup of the copying machine 400 and various signals. FIG. 8(*a*) is a timing chart representing the power supply status, FIG. 8(*b*) a timing chart showing the startup status of the system CPU 421, FIG. 8(*c*) a timing chart showing the fixing control allowance signal, FIG. 8(*d*) a timing chart showing the startup status of the sub-CPU 431, FIG. 8(*e*) a timing chart showing the fixing control status of-the fixing device 454, FIG. 8(*f*) a timing chart showing the startup status of the engine CPU 431, FIG. 8(*g*) a timing chart showing the initial startup status of the ADF 451, FNS 452 and engine section 453, and FIG. 8(*h*) a timing chart showing the image formation enabling status of the copying machine 400.

In the copying machine 400, the power supply switch 11 is turned on by the operation of the operator, and startup operation is performed, as shown in FIG. 8(*a*). As shown in FIGS. 8(*b*), (*d*) and (*f*), the power supply switch 11 is turned on and startup operations of the system CPU 421, engine CPU 431 and sub-CPU 432 are performed. In the system CPU 421, the boot program is scanned and startup is performed.

As shown in FIG. 8(*d*), startup of the sub-CPU 432 completes. Further, as shown in FIG. 8(*b*), the startup of the boot program of the system program 21 completes. The error latch information when the power was off in the last operation stored in the memory 22 is read out by the system CPU 421 and the fixing control allowance signal based on this error latch information is sent to the sub-CPU 432. To put it more specifically, when the error latch information indicates that an error occurred when the power was off in the last operation, the fixing control allowance signal that disables fixing is sent to the sub-CPU 432. If the error latch information does not indicate that an error occurred when the power was off in the last operation, the fixing control allowance signal that enables fixing control is sent to the sub-CPU 432. If the error latch information does not indicate that an error occurred when the power was off in the last operation, the fixing device 454 is not placed under heat control for safety.

In the system CPU 421, the startup of various application programs is initiated after completion of the startup by the boot program, as shown in FIG. 8(*b*). As shown in FIG. 8(*c*), based on the fixing control allowance signal that enables fixing is sent to the sub-CPU 432, the sub-CPU 432 inputs the control signal to the fixing device 454 through the OR circuit 433 and AND circuit 434, and fixed control for performing the predetermined heating start.

As shown in FIG. 8(*f*), the engine CPU 431 completes startup. After completion of startup of the engine CPU 431, communication is established between the engine CPU 431 and sub-CPU 32. The peripheral circuit of the engine CPU 431 is initialized. After establishment of the communication, the fixing control of the fixing device 454 by the sub-CPU 432 terminates and the fixing control of the fixing device 454 by the engine CPU 431 starts. As shown in FIG. 8(*g*), initial control of each of the loads of the ADF 451, FNS 452 and engine section 453 by the engine CPU 431 starts. For example, when the fixing termination signal is sent from the sub-CPU 432 to the engine CPU 431, the engine CPU 431 performs fixing control of the fixing device 454 according to the fixing termination signal having been received by the engine CPU 431.

For example, the temperature on the surface of the fixing roller of the fixing device 454 is heated up to about 400° C. by the fixing control of the fixing device 454 by the sub-CPU 432. Further, the initial control of each load represents the control of each load until image formation is enabled.

As shown in FIG. 8(*e*), the fixing device 454 is heated up to the temperature that enables image formation (e.g. about 20° C.), and image formation is enabled. Further, as shown in FIG. 8(*g*), each of the loads of the ADF 451, FNS 452 and engine section 453 is placed under initial control by the engine CPU 431 so that image formation is enabled. As shown in FIG. 8(*b*), in the system CPU 421, startup by various types of application programs completes, and startup operation is thoroughly completed. Communication is established between the system CPU 421 and sub-CPU 432, and the peripheral circuit of the system CPU 421 is initialized.

As shown in FIG. 8(*h*), evaluation is made by the system CPU 421 to determine whether or not the initial control of each load and that of the fixing device 454 have completed. If each control has been completed, the following control is started: control of image formation enable status in the print control section 441 and FAX control section 442 by the system CPU 421; control of image formation enable status in the ADF 451, FNS 452, engine section 453 and fixing device 454 by the engine CPU 431; and control of image formation enable status in the scanner 55 by the sub-CPU 432. Then the copying machine 400 is put into the image formation enable mode.

According to the present embodiment, after turning on the power supply switch 11, a predetermined fixing control is applied to the system CPU 421. This arrangement ensures an earlier start of the fixing operation by the fixing device 454, and reduces the influence of the startup time of the system CPU 411, hence the time from turning on of power to enabling of image formation.

Further, after completion of the startup of the engine CPU 431, the sub-CPU 432 terminates predetermined fixing control applied to the fixing device 454, and the engine CPU 431 starts fixing control of the fixing device 454. This method ensures safer fixing control through the engine CPU 431 and reduces the time from turning on of power to enabling of image in the copying machine 400, through the fixing control of the sub-CPU 432.

In response to the fixing control allowance signal received from the system CPU 421, the sub-CPU 432 applies predetermined fixing control to the fixing device 454. This method ensures safer fixing control through the sub-CPU 432, based on the fixing control allowance signal.

The above description of the embodiments is only a preferred example of the present invention, without the present invention being restricted thereto. The detailed configuration of each component making up the image forming apparatus of the aforementioned embodiments, and detailed operations thereof can be embodied in variations with appropriate modification or additions without departing from the technological spirit and scope of the invention claimed.

For example, in the aforementioned embodiment, the copying machine 400 is used for the explanation of an image forming apparatus. Without being restricted thereto, a printer can be used for the explanation of an image forming apparatus. Further, in the aforementioned embodiment, the CPU for the control of the scanner 55 is used as a sub-CPU 432. Without being restricted thereto, a new CPU can be provided for exclusive use in initial heating of the fixing device 454.

In the aforementioned embodiment, to ensure safe fixing control, the fixing control allowance signal is sent to the sub-CPU 432 after completion of the startup of the system CPU 421 by the boot program, and, based on the fixing control allowance signal, the sub-CPU 432 control the fixing device 454. However, without being restricted thereto, it is also possible to arrange such a configuration that the sub-CPU 432 automatically applies predetermined fixing control to the fixing device 454, after completion of the startup of the sub-CPU 432. This arrangement ensures earlier start of fixing control than the arrangement wherein the fixing control allowance signal from the system CPU 421 to the sub-CPU 432, and further reduces the time from turning on of power to enabling of image formation.

[Embodiment 4]

Figure 9:
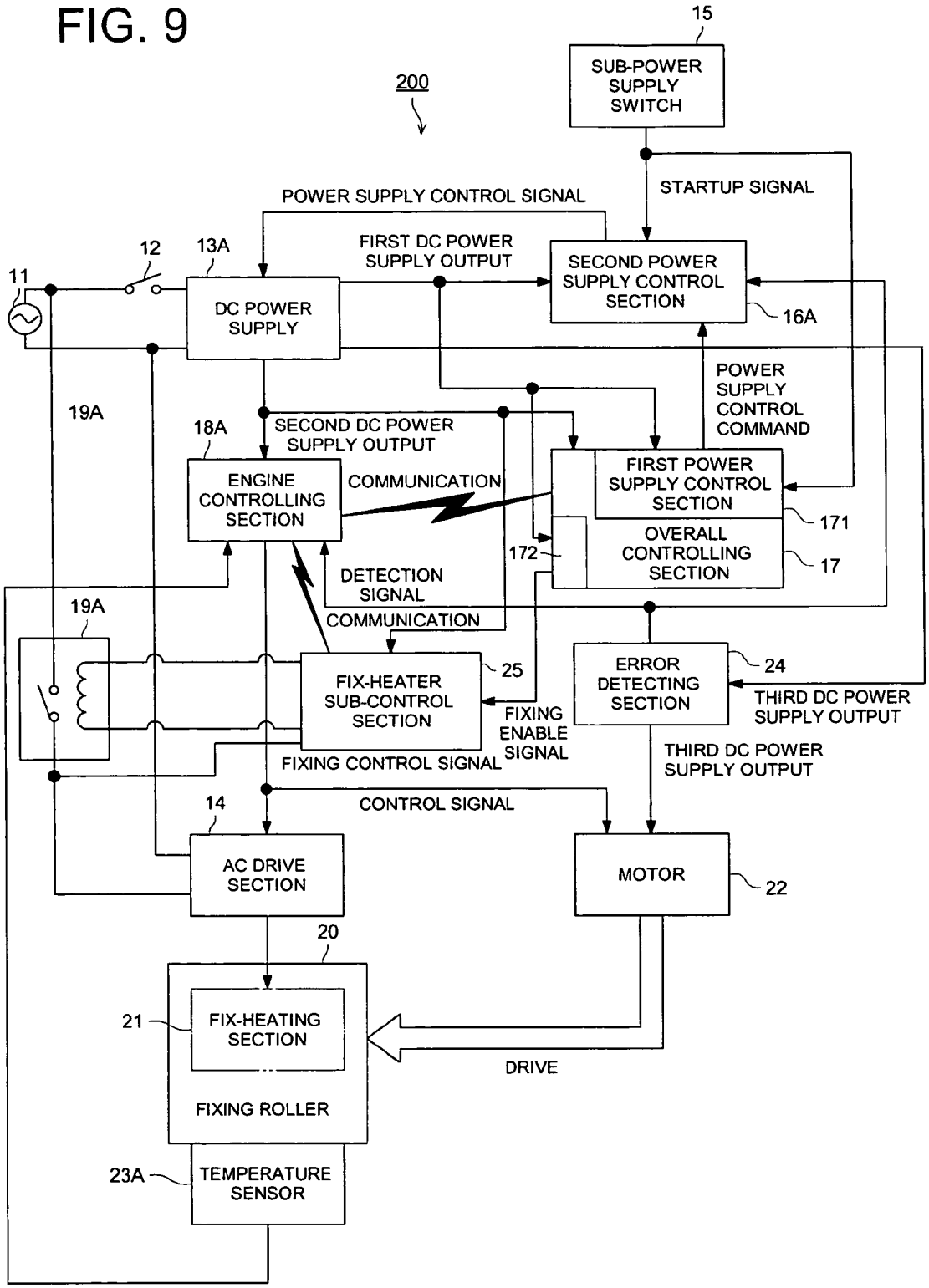
FIG. 9 is a block diagram representing the control configuration of a copying machine 200 as a third embodiment of the present invention.
Figure 10:
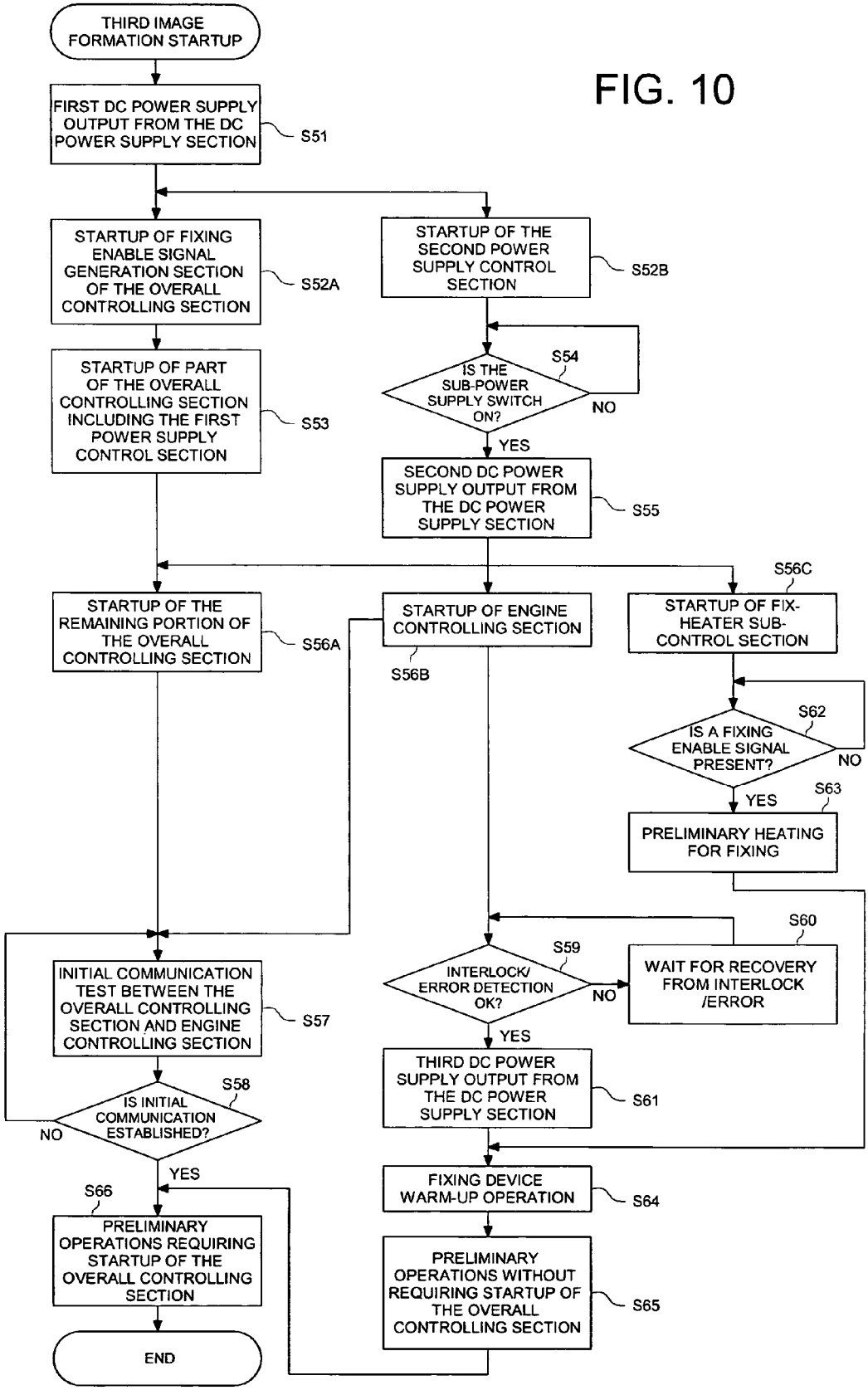
FIG. 10 is a flowchart showing third image formation startup processing.
Figure 11:
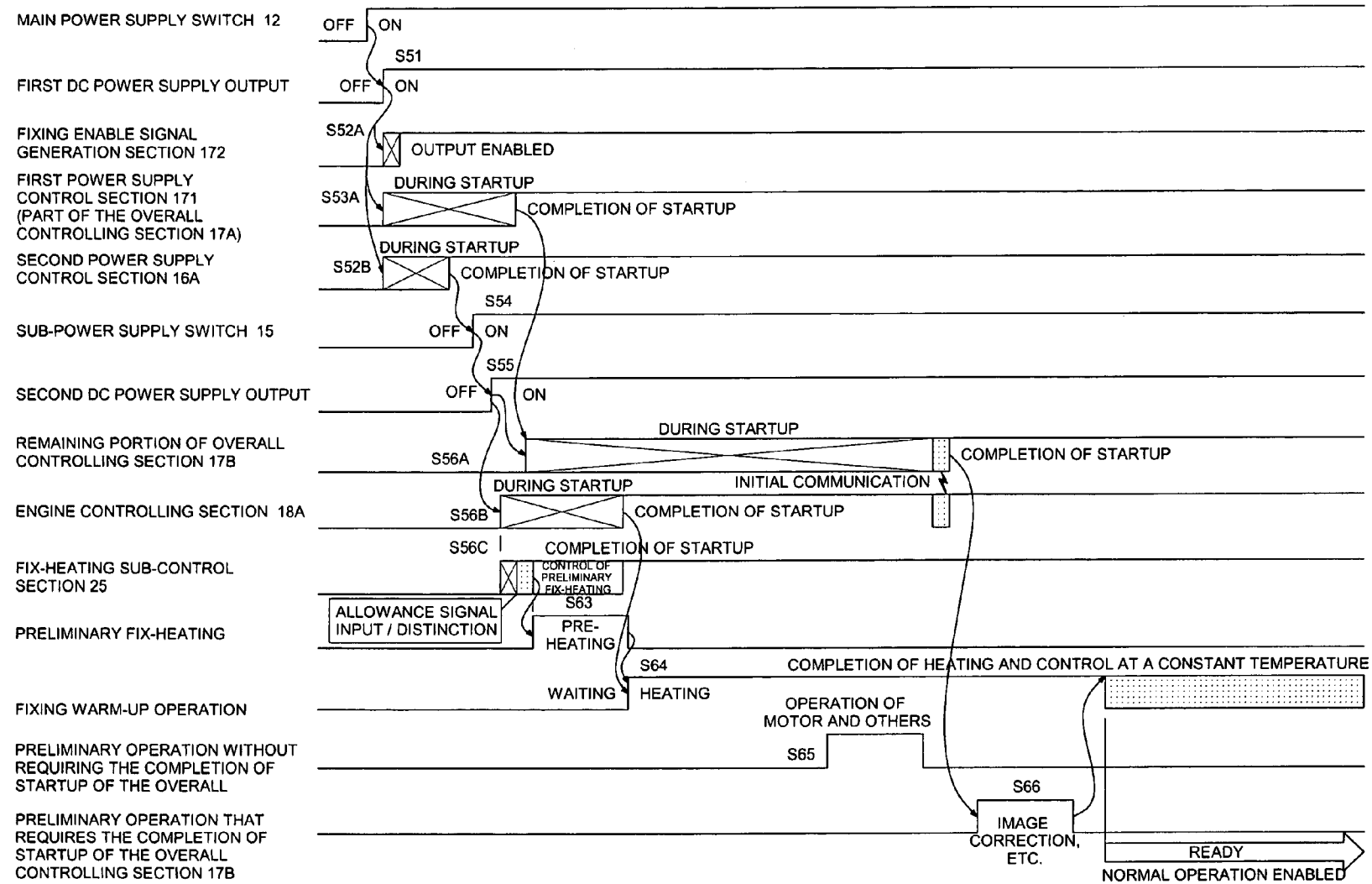
FIG. 11 is a timing chart showing third image formation startup processing.
Figure 12:
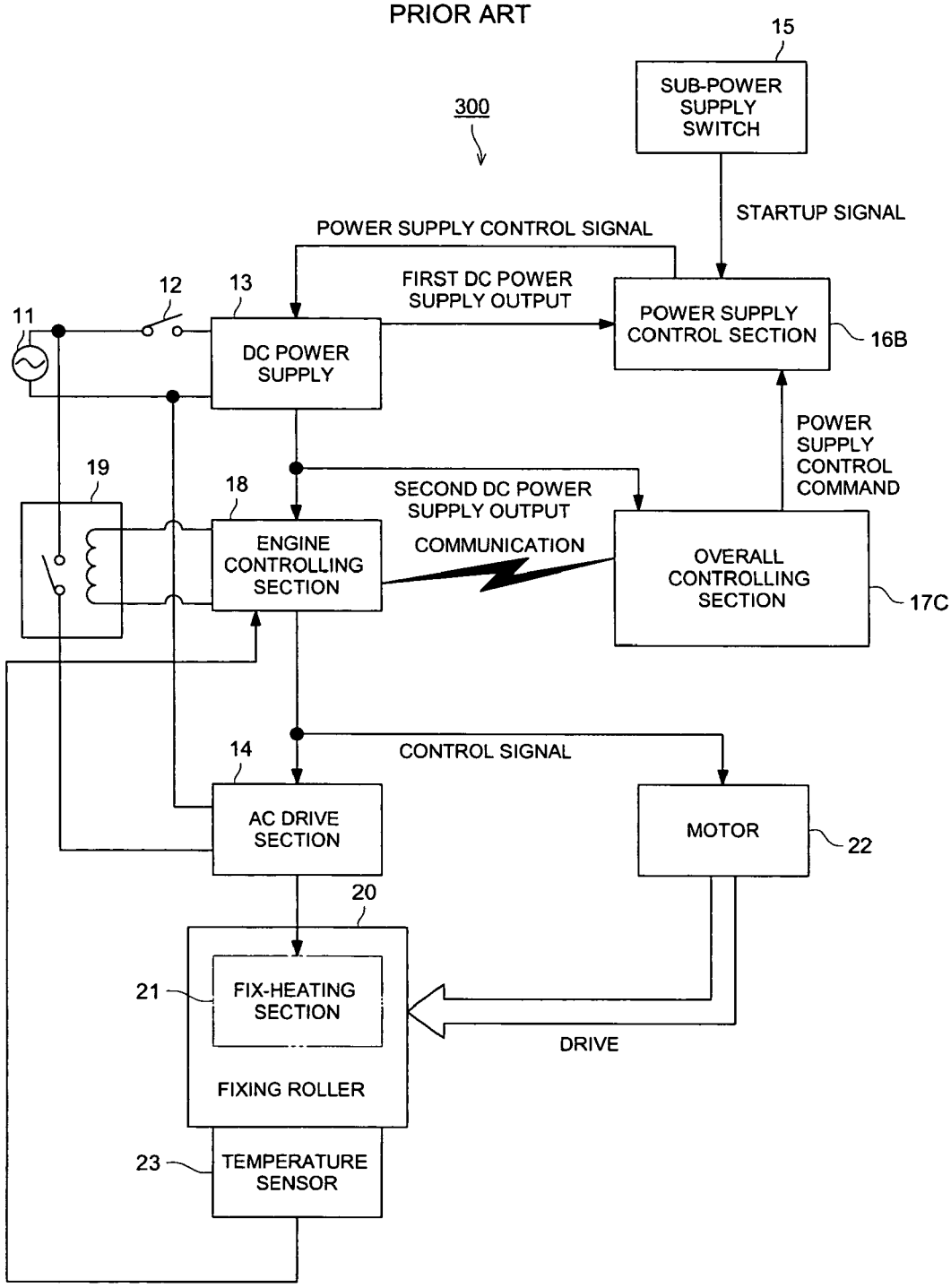
FIG. 12 PRIOR ART
FIG. 12 is a block diagram representing the control configuration of a conventional copying machine 300.
Figure 13:
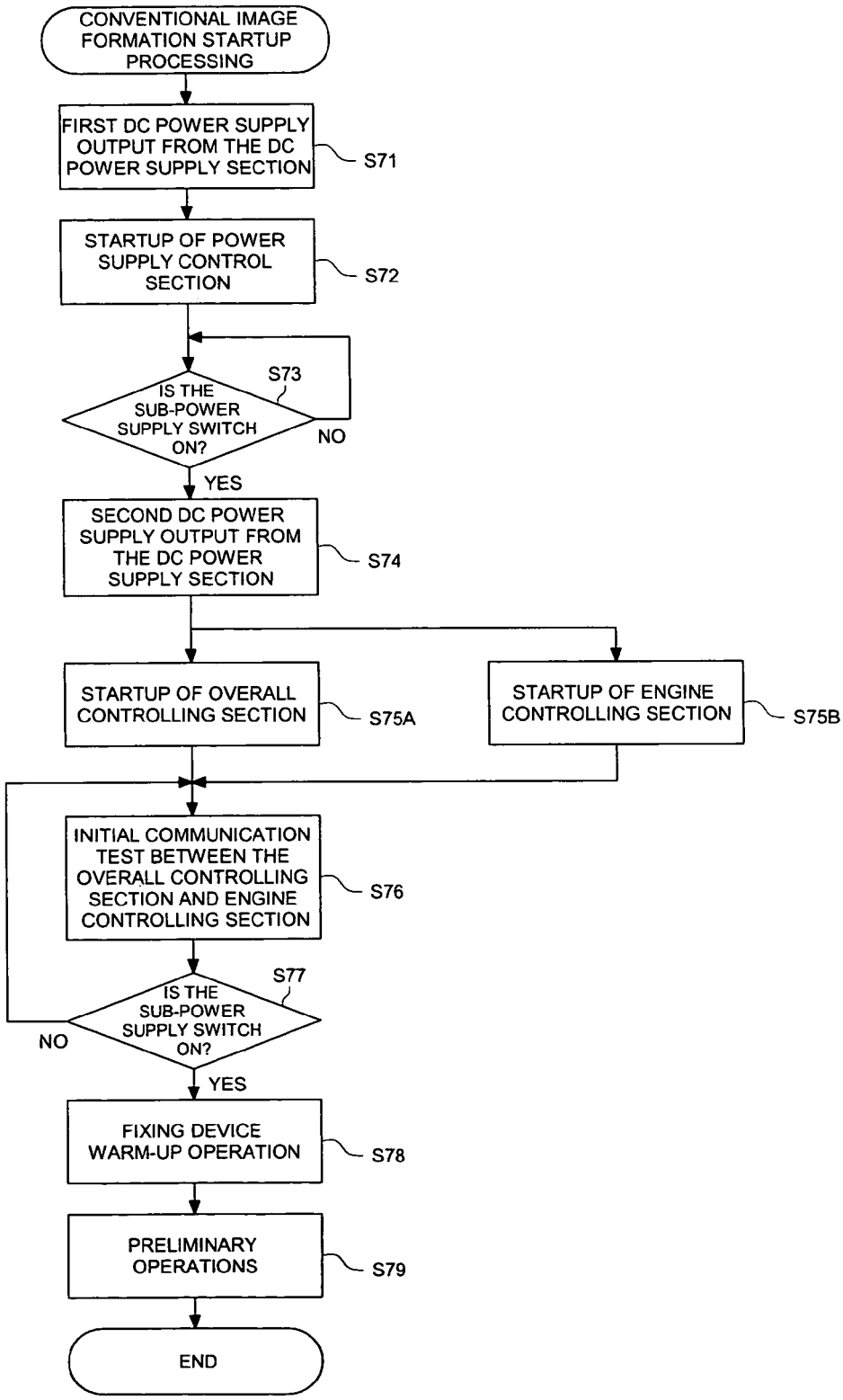
FIG. 13 PRIOR ART
FIG. 13 is a flowchart showing conventional image formation startup processing.

Referring to FIGS. 9 through 11, the following describes the fourth embodiment of the present invention. FIG. 9 shows the control configuration of the copying machine 200. FIG. 10 indicates the third image formation startup processing. Reference numerals corresponding to Steps are given in a timing chart of FIG. 11.

Many portions in this embodiment are shared by those in the second embodiment. The following describes the present embodiment with particular reference to the differences from the second embodiment. For the explanation of the present embodiment, a copying machine 200 shown in FIG. 9, in place of the copying machine 100 of the second embodiment, will be used. The copying machine 200 comprises a DC power supply 13A, overall controlling section 17B, engine controlling section 18A, main relay 19A and temperature sensor 23A, in place of the DC power supply 13, overall controlling section 17A, engine controlling section 18, main relay 19, and temperature sensor 23 of the copying machine 100. The copying machine 200 further comprises a fix-heating sub-control section 25.

The DC power supply 13A converts the AC supply power inputted from the AC power supply 11, and sends the DC power supply output as a first DC power supply output to the first power supply control section 171, second power supply control section 16A and fixing enable signal generation section 172. In response to the power supply control signal inputted from the second power supply control section 16A, the DC power supply 13A generates the appropriate DC power supply output and sends it to the engine controlling section 18A and fix-heating sub-control section 25.

The overall controlling section 17B is different from the overall controlling section 17A in that it fixing enable signal generation section 172 that generates fixing enable signal, in addition to the first power supply control section 171. The fixing enable signal indicates that (preliminary) heating of the fixing roller 20 by the fix-heating section 21 is enabled. After startup, the fixing enable signal generation section 172 refers to the memory (not illustrated) and checks whether or not history information is stored, wherein the aforementioned history information indicates that a state (an error) has occurred, in which preliminary fixing and heating should not be performed in the next startup operation, upon completion of the startup of the copying machine 200. If this error information is not stored, the fixing enable signal generation section 172 generates the fixing enable signal and sends it to the fix-heating sub-control section 25.

The engine controlling section 18A is not connected to the main relay 19A. It differs from the engine controlling section 18 in that the main relay 19A is not directly connected. The main relay 19A is connected to the fix-heating sub-control section 25.

The fix-heating sub-control section 25 directly controls the on/off operation of the main relay 19A. Before the copying machine 200 is enabled for image formation, the fix-heating sub-control section 25 controls the AC drive section 14 and applies heating control to the fix-heating section 21, according to the fixing enable signal issued from the overall controlling section 17B and the temperature detection signal inputted from the temperature sensor 23A. The fix-heating sub-control section 25 is characterized by very short time required for startup. Further, the fix-heating sub-control section 25 is provided for exclusive use, without being restricted thereto. For example, it is also possible to arrange such a configuration that fix-heating sub-control section 25 can also be used as the existing control section, such as the control section of the image reading section 30. The temperature sensor 23A detects the temperature of the fixing roller 20 and sends the temperature detection signal to the engine controlling section 18 and fix-heating sub-control section 25.

The following describes the fourth image formation startup processing as one of the operations of the copying machine 200. The fourth image formation startup processing is the same as the second fourth image formation startup processing, except that it starts up the fix-heating sub-control section 25 in parallel with the engine controlling section 18, and performs preliminary heating for fixing. When the main power supply switch 12 has been turned on in the copying machine 200, the third image formation startup processing is carried out, as shown in FIGS. 10 and 11.

In the first place, the Step S51 is performed. The Step S51 is the same as Step S31 for the second image formation startup processing in FIG. 5. The fixing enable signal generation section 172 of the overall controlling section 17B is started by the first DC power supply output (Step S52A). After the fixing enable signal generation section 172 has started, part of the overall controlling section 17B including the first power supply control section 171 other than the fixing enable signal generation section 172 is also started (Step S53). It should be noted that Steps S52A and S53 can be started in parallel, as shown in FIG. 11.

In parallel with the Step S52A, the Step S52B is performed, and Steps S54, S55, S56B and S56A are performed. The Steps S52B, S54, S55, S56B and S56A are the same as Steps S32B, S33, S34, S35B and S35A in the second image formation startup processing. In parallel with the performance of the Step S56B, the fix-heating sub-control section 25 is started by the second DC power supply output (Step S56C). After the fix-heating sub-control section 25 has been started, evaluation is made by the fix-heating sub-control section 25 to determine whether or not the fixing enable signal has been issued from the fixing enable signal generation section 172 of the overall controlling section 17B having been started in Step S52A, and has been inputted into the fix-heating sub-control section 25 (Step S62).

If the fixing enable signal is not inputted (NO in Step S62), the system proceeds to the Step S62. When the fixing enable signal has been inputted (YES in Step S62), the main relay 19A is turned on by the fix-heating sub-control section 25. The fixing control signal is generated and outputted to be inputted into the AC drive section 14. The fixing roller 20 is heated on a preliminary basis by the power supplied to the fix-heating section 21 from the AC power supply 11 through the AC drive section 14 (Step S63). In the preliminary heating, the temperature of the fixing roller 20 is detected through the temperature sensor 23A by the fix-heating sub-control section 25. If the detected temperature of the fixing roller 20 has reached the predetermined level before the engine controlling section 18 starts, the temperature of the fixing roller 20 is controlled through the fix-heating section 21 until the engine controlling section 18 starts up, to ensure that the predetermined temperature will be detected. Then the Steps S57 through S61 and S64 through S66 are performed. The Steps S57 through S61 and S64 through S66 are the same as Steps S36 through S43 in the second embodiment.

In Step S64, preliminary heating for fixing in Step S63 is terminated before performance of the Step S61 completes. Communication is tried and established between the fix-heating sub-control section 25 and engine controlling section 18A. After establishment of the communication, if the detected temperature of the fixing roller 20 has not reached the predetermined level, the subject under fixing control is switched from the fix-heating sub-control section 25 over to the engine controlling section 18A, and the fixing roller 20 is heated through the fix-heating section 21 by the control of the engine controlling section 18A, and the fixing device 60 is warmed up.

According to the present embodiment, when the main power supply switch 12 is turned on, the fixing enable signal generation section 172 of the overall controlling section 17B and power supply control section 16A are started in parallel. The second power supply control section 16A having started up starts the engine controlling section 18A and fix-heating sub-control section 25 through the DC power supply 13 by the second DC power supply output. After the first power supply control section 171 has started up, the remaining portion of the overall controlling section 17B is started by the second DC power supply output. If the engine controlling section 18A has not started, but the fix-heating sub-control section 25 has started, then the fixing roller 20 is heated on a preliminary basis through the fix-heating section 21 by the fix-heating sub-control section 25. This arrangement provides an earlier start of heating the fixing roller 20, and reduces the influence of the startup time of the overall controlling section 17B and engine controlling section 18A, hence the time from turning on of power to enabling of image formation.

If the fixing roller 20 has reached the predetermined temperature before the startup of the engine controlling section 18, the fix-heating sub-control section 25 controls the temperature of the fixing roller 20 through the fix-heating section 21 until the engine controlling section 18 starts up, so as to maintain the predetermined temperature. If the fixing roller 20 has not reached the predetermined temperature upon completion of the startup of the engine controlling section 18, the engine controlling section 18 heats the fixing roller 20 through the fix-heating section 21 after its startup. This method provides safer heating of the fixing roller 20.

In response to the fixing enable signal from the fixing enable signal generation section 172, the fix-heating sub-control section 25 heats the fixing roller 20 through the fix-heating section 21. This method provides safer preliminary heating.

The above description of the embodiments is only a preferred example of the present invention, without the present invention being restricted thereto.

The detailed configuration of each component making up the image forming apparatus of the aforementioned embodiment, and detailed operations thereof can be embodied in variations with appropriate modification or additions without departing from the technological spirit and scope of the invention claimed.

For example, in the aforementioned embodiment, the copying machine 100 and copying machine 200 are used for the explanation of an image forming apparatus. Without being restricted thereto, a printer can be used for the explanation of an image forming apparatus. Further, in the aforementioned embodiment, the sub-power supply switch 15 for switching between on/off statuses by the operator is used as a startup means. Without being restricted thereto, a power supply switch under remote control from an external device on the network via the communications network can be used as a startup means.

In the aforementioned embodiment, the second power supply control section 16A is separate from the engine controlling sections 18 and 18A. Without being restricted thereto, the second power supply control section 16A can be built integrally with the engine controlling sections 18 and 18A. Further, in the aforementioned embodiment, the first power supply control section 171 is included in the overall controlling section 17A. Without being restricted thereto, the overall controlling section 17A and first power supply control section 171 can be controlled by the overall controlling section 17A. In the third embodiment, the fixing enable signal generation section 172 is included in the overall controlling section 17B. Without being restricted thereto, the fixing enable signal generation section 172 arranged separately from the overall controlling section 17B can be controlled by the overall controlling section 17B.

In the aforementioned embodiment, after completion of the startup of the overall controlling section 17A, the first power supply control section 171 generates the power supply control command which is inputted into the second power supply control section 16A. Without being restricted thereto, after the completion of startup of the overall controlling sections 17A and 17B, the first power supply control section 171 generates the power supply control signal directly, which is inputted into the DC power supply 13 through the second power supply control section 16A.

The fixing roller 20 is heated on a preliminary basis before startup of the engine controlling section in the fourth embodiment. This arrangement can be combined with the arrangement of the first embodiment.

Disclosed embodiment can be varied by a skilled person without departing from the spirit and scope of the invention.

What is claimed is:

1. An apparatus for forming an image on a recording medium, comprising:

a main power switch to turn ON/OFF an AC power source to be supplied into said apparatus;

a DC power current generating section to convert AC power current, fed from said AC power source, to DC power current;

an overall-controlling section to control overall operations of said apparatus;

an engine-controlling section to conduct a predetermined controlling operation among controlling operations to be conducted in said apparatus;

a first power-controlling section, included in said overall-controlling section; and a second power-controlling section, having a starting time shorter than that of said first power-controlling section;

wherein, when said main power switch is turned ON, said DC power current generating section supplies a first DC power current to both a part of said overall-controlling section including said first power-controlling section and said second power-controlling section, so as to commence to activate them, and then, said second power-controlling section generates a power controlling signal after a sub-power supply switch is turned ON, so as to input said power controlling signal into said DC power current generating section; and wherein, based on said power controlling signal inputted from said second power-controlling section, said DC power current generating section generates a second DC power current, and then, supplies said second DC power current into both another residual part of said overall-controlling section and said engine-controlling section so as to activate them; and wherein said overall-controlling section is activated by said second DC power current, fed from said DC power current generating section, after said initial settings of said first power-controlling section are completed, and then, said first power-controlling section controls said DC power current, outputted from said DC power current generating section, after initial settings of said overall-controlling section are completed.

2. The apparatus of claim 1, wherein, when said main power switch is turned ON, said DC power current generating section commences to activate both said first power-controlling section and said second power-controlling section in parallel.

3. The apparatus of claim 1, further comprising:

a fixing section to fix a developed image on a recording medium; and a sub-controlling section, having a starting time shorter than that of said engine-controlling section, to control a heating operation conducted by said fixing section;

wherein, based on said power controlling signal inputted from said second power-controlling section, said DC power current generating section also supplies said second DC power current into said sub-controlling section so as to activate said sub-controlling section; and wherein said sub-controlling section controls said fixing section, so that a pre-heating operation of said fixing section is conducted by employing said AC power current supplied from said AC power source, before initial settings of said engine-controlling section are completed.

4. The apparatus of claim 3, wherein, when a temperature of said fixing section reaches to a predetermined temperature before said initial settings of said engine-controlling section are completed, said sub-controlling section keeps to a temperature controlling operation so as to maintain said predetermined temperature until said initial settings of said engine-controlling section are completed; and wherein, in case that a temperature of said fixing section does not reach to said predetermined temperature when said initial settings of said engine-controlling section are completed, said engine-controlling section conducts an operation for heating said fixing section.

5. The apparatus of claim 3, further comprising:

a fixing-allowance signal generating section to generate a fixing-allowance signal for enabling said pre-heating operation of said fixing section;

wherein, when said main power switch is turned ON, said DC power current generating section also supplies said first DC power current to said fixing-allowance signal generating section, so as to commence to activate it, and then, said fixing-allowance signal generating section generates said fixing-allowance signal when said pre-heating operation of said fixing section is possible after said initial settings of said engine-controlling section are completed; and wherein, based on said fixing-allowance signal, said sub-controlling section controls said fixing section, so as to conduct said pre-heating operation of said fixing section.

6. The apparatus of claim 1, further comprising:

an activating section to turn ON/OFF said DC power current;

wherein, when said activating section turns ON said DC power current, said second power-controlling section controls a second DC power current outputted from said DC power current generating section.

7. The apparatus of claim 1, wherein said second power-controlling section is integrally included in said engine-controlling section.

8. The apparatus of claim 1, wherein said starting time of said second power-controlling section is shorter than 1 second.

9. An apparatus for forming an image on a recording medium, comprising:

a main power switch to turn ON/OFF an AC power source to be supplied into said apparatus;

a DC power current generating section to convert AC power current, fed from said AC power source, to DC power current;

a power-source controlling section to control said DC power current outputted from said DC power current generating section;

an overall-controlling section to control overall operations of said apparatus;

an engine-controlling section to conduct a predetermined controlling operation among controlling operations to be conducted in said apparatus; and a fixing section to fix a toner image on a recording medium;

wherein, when said main power switch is turned ON, said DC power current generating section supplies a first DC power current to said power-source controlling section so as to commence to activate it, and then, said power-source controlling section generates a first power controlling signal so as to input said first power controlling signal into said DC power current generating section; and wherein, based on said first power controlling signal inputted from said power-source controlling section, said DC power current generating section generates a second DC power current, and then, supplies said second DC power current into both said overall-controlling section and said engine-controlling section so as to commence to activate them; and wherein said power-source controlling section generates a second power controlling signal after initial settings of said engine-controlling section are completed, so as to input said second power controlling signal into said DC power current generating section; and wherein, based on said second power controlling signal inputted from said power-source controlling section, said DC power current generating section generates a third DC power current; and wherein said engine-controlling section, whose initial settings are already completed, conducts a heating operation of said fixing section by employing AC power current, fed from said AC power source, and controlling operations so as to implement a preliminary operation, which does not require a completion of initial settings of said overall-controlling section and does not include a pre-heating operation, by employing said third DC power current generated by said DC power current generating section; and wherein said overall-controlling section conducts controlling operations so as to implement another preliminary operation, which requires said completion of initial settings of said overall-controlling section, after said preliminary operation conducted by said engine-controlling section is completed.

10. The apparatus of claim 9, wherein said DC power current generating section commences to activate both said overall-controlling section and said engine-controlling section in parallel.

11. The apparatus of claim 9, further comprising:

a sub-controlling section, having a starting time shorter than that of said engine-controlling section, to control a heating operation conducted by said fixing section;

wherein, based on said first power controlling signal inputted from said power-source controlling section, said DC power current generating section also supplies said second DC power current into said sub-controlling section so as to activate said sub-controlling section; and wherein said sub-controlling section controls said fixing section, so that a pre-heating operation of said fixing section is conducted by employing said AC power current supplied from said AC power source, before initial settings of said engine-controlling section are completed.

12. The apparatus of claim 11, wherein, when a temperature of said fixing section reaches to a predetermined temperature before said initial settings of said engine-controlling section are completed, said sub-controlling section keeps to a temperature controlling operation so as to maintain said predetermined temperature until said initial settings of said engine-controlling section are completed; and wherein, in case that a temperature of said fixing section does not reach to said predetermined temperature when said initial settings of said engine-controlling section are completed, said engine-controlling section conducts an operation for heating said fixing section.

13. The apparatus of claim 11, further comprising:

a fixing-allowance signal generating section to generate a fixing-allowance signal for enabling said pre-heating operation of said fixing section;

wherein, when said main power switch is turned ON, said DC power current generating section also supplies said first DC power current to said fixing-allowance signal generating section, so as to commence to activate it, and then, said fixing-allowance signal generating section generates said fixing-allowance signal when said pre-heating operation of said fixing section is possible after said initial settings of said engine-controlling section are completed; and wherein, based on said fixing-allowance signal, said sub-controlling section controls said fixing section, so as to conduct said pre-heating operation of said fixing section.

14. An apparatus for forming an image on a recording medium, comprising:

a main power switch to turn ON/OFF an AC power source to be supplied into said apparatus;

a DC power current generating section to convert AC power current, fed from said AC power source, to DC power current;

an overall-controlling section to control overall operations of said apparatus;

an engine-controlling section to conduct a predetermined controlling operation among controlling operations to be conducted in said apparatus; and a fixing section to fix a toner image on a recording medium;

wherein, when said main power switch is turned ON, said DC power current generating section generates said DC power current and supplies said DC power current into both said overall-controlling section and said engine-controlling section, so as to commence to activate them; and wherein said engine-controlling section, whose initial settings are already completed, conducts a heating operation of said fixing section by employing AC power current, fed from said AC power source, and controlling operations so as to implement a preliminary operation, which does not require a completion of initial settings of said overall-controlling section and does not include a pre-heating operation, by employing said DC power current generated by said DC power current generating section; and wherein at least one of a heating time of said fixing section heated by said engine-controlling section and an operating time of said preliminary operation overlaps with a starting time of said overall-controlling section in at least a part.

15. The apparatus of claim 9, further comprising:

an activating section to turn ON/OFF said DC power current;

wherein, when said activating section turns ON said DC power current, said power-source controlling section controls a second DC power current outputted from said DC power current generating section.

16. The apparatus of claim 9, further comprising:

an abnormality detecting section to detect an abnormality of said apparatus;

wherein, when said abnormality detecting section detects none of said abnormality of said apparatus, said power-source controlling section generates said third DC power current; and wherein, when said abnormality detecting section detects none of said abnormality of said apparatus, said engine-controlling section, whose initial settings are already completed, controls said preliminary operation, which does not require a completion of said initial settings of said overall-controlling section.

17. The apparatus of claim 9, further comprising at least one of:

a photoreceptor drum to form a toner image on it;

a developing section to store a developing agent including toner;

a polygon motor unit to irradiate and scan a laser beam onto said photoreceptor drum;

a charging section, having a first electrode, to charge said photoreceptor drum;

a transferring section, having a second electrode, to transfer said toner image;

a separating section, having a third electrode, to separate a transfer paper from said photoreceptor drum;

an accommodating section to accommodate said transfer paper; and an image-reading section to read an image on an original document;

wherein said preliminary operation, which does not require said completion of said initial settings of said overall-controlling section, is at least one of:

a heating temperature adjustment at said fixing section and a pre-rotating operation of a fixing roller;

a toner density correction at said developing section;

an operation for rotating a polygon motor at said polygon motor unit;

an operation for cleaning said first electrode;

an operation for cleaning said second electrode;

an operation for cleaning said third electrode;

an operation for cooling an inside space of said apparatus;

an operation for retuning said image-reading section to a home position; and an operation for retuning said accommodating section to a home position.

18. The apparatus of claim 3, wherein said fixing section is heated by employing an electromagnetic induction phenomenon.

19. The apparatus of claim 6, wherein a starting time, defined as a time period from a time when said main power switch or said activating section turns ON to a time when an image-forming operation is enabled, is equal to or shorter than 30 seconds.

20. An apparatus for forming an image on a recording medium, comprising:

a fixing section to fix a developed image on said recording medium by applying heat and pressure onto said developed image formed on said recording medium;

peripheral load sections to conduct predetermined operations other than main image-forming operations;

a system CPU to control overall sections included in said apparatus;

an engine CPU to control said fixing section and said peripheral load sections; and a sub CPU, having a starting time shorter than that of said engine CPU and that of said system CPU; and wherein, when a starting time of said sub CPU has elapsed after a power source is turned ON, said sub CPU commences to conduct a predetermined fixing-control operation for said fixing section.

21. The apparatus of claim 20, wherein said sub CPU finalizes said predetermined fixing-control operation for said fixing section, after initial settings of said engine CPU are completed; and wherein said engine CPU commences to conduct fixing-control operations for said fixing section at a same time when said predetermined fixing-control operation is finalized.

22. The apparatus of claim 20, wherein, when initial settings of said system CPU are completed in such a state that a fixing-control allowance signal, for allowing fixing-control operations of said fixing section, can be transmitted to said sub CPU, said system CPU transmits said fixing-control allowance signal to said sub CPU, based on an abnormality status latched at a previous operating time of said apparatus; and wherein said sub CPU conducts said predetermined fixing-control operation for said fixing section, based on said fixing-control allowance signal received from said system CPU.

* * * * *